US006916587B2

(12) United States Patent
Fushimi et al.

(10) Patent No.: US 6,916,587 B2
(45) Date of Patent: Jul. 12, 2005

(54) TONER, DEVELOPER, AND IMAGE FORMING METHOD AND APPARATUS

(75) Inventors: Hiroyuki Fushimi, Shizuoka-ken (JP); Toshiki Nanya, Shizuoka-ken (JP); Osamu Uchinokura, Shizuoka-ken (JP); Shinichiro Yagi, Shizuoka-ken (JP); Kohki Katoh, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 57 days.

(21) Appl. No.: 10/114,056

(22) Filed: Apr. 3, 2002

(65) Prior Publication Data

US 2003/0022080 A1 Jan. 30, 2003

(30) Foreign Application Priority Data

| | | |
|---|---|---|
| Apr. 3, 2001 | (JP) | 2001-104861 |
| Jun. 21, 2001 | (JP) | 2001-188490 |
| Jul. 9, 2001 | (JP) | 2001-208441 |

(51) Int. Cl.[7] ..... G03G 9/087

(52) U.S. Cl. ..... 430/108.4; 430/109.4; 430/124; 430/111.4; 430/45; 399/262

(58) Field of Search ..... 430/108.4, 109.4, 430/111.4, 124, 45, 108.22, 108.23, 107.1; 101/262

(56) References Cited

U.S. PATENT DOCUMENTS

| | | | | |
|---|---|---|---|---|
| 5,597,673 | A | 1/1997 | Watanabe et al. | |
| 5,728,501 | A | 3/1998 | Nakanishi et al. | |
| 6,074,794 | A | 6/2000 | Fushimi et al. | |
| 6,183,926 | B1 | 2/2001 | Kuroda et al. | |
| 6,212,351 | B1 | 4/2001 | Kawagoe et al. | |
| 6,258,502 | B1 | 7/2001 | Nakamura et al. | |
| 6,269,228 | B1 | 7/2001 | Kayahara et al. | |
| 6,303,258 | B1 | 10/2001 | Katoh et al. | |
| 6,360,068 | B1 | 3/2002 | Kinoshita et al. | |
| 6,363,229 | B1 | 3/2002 | Shiraishi et al. | |
| 6,395,442 | B1 * | 5/2002 | Hayashi et al. | 430/109.4 |
| 6,395,443 | B2 | 5/2002 | Kuroda et al. | |
| 6,403,275 | B1 | 6/2002 | Kuramoto et al. | |
| 6,405,002 | B2 | 6/2002 | Ogiyama et al. | |
| 6,406,826 | B1 | 6/2002 | Suzuki et al. | |
| 6,432,589 | B1 | 8/2002 | Uchinokura et al. | |
| 6,432,590 | B1 | 8/2002 | Ueda et al. | |
| 6,445,900 | B2 | 9/2002 | Fukao et al. | |
| 6,449,453 | B1 | 9/2002 | Motohashi | |
| 6,468,706 | B2 | 10/2002 | Matsuda et al. | |
| 6,475,690 | B2 * | 11/2002 | Anno et al. | 430/108.8 |
| 6,505,024 | B2 | 1/2003 | Kayahara et al. | |
| 6,506,530 | B1 * | 1/2003 | Kido et al. | 430/108.8 |
| 6,541,173 | B1 * | 4/2003 | Kido et al. | 430/109.4 |

FOREIGN PATENT DOCUMENTS

| | | |
|---|---|---|
| EP | 0 772 093 A1 | 5/1997 |
| EP | 0 883 034 A3 | 12/1998 |
| JP | 63-88564 | 4/1988 |
| JP | 63-184762 | 7/1988 |
| JP | 3-056974 | 3/1991 |
| JP | 6-230609 | 8/1994 |
| JP | 8-30017 | 2/1996 |
| JP | 9-171271 | 6/1997 |
| JP | 9-211896 | 8/1997 |
| JP | 11-218965 | 8/1999 |

OTHER PUBLICATIONS

XP00220394; Abstract;Derwent Publications Ltd., London, GB; May 18, 1993;Section CH, Week 199324.

* cited by examiner

*Primary Examiner*—John Goodrow
(74) *Attorney, Agent, or Firm*—Oblon, Spivak, McClelland, Maier & Neustadt, P.C.

(57) ABSTRACT

A toner including at least a binder resin; a colorant; and a charge controlling agent, in which the binder resin includes at least a polyester resin having a molecular weight distribution such that components having a molecular weight not greater than 500 are included in an amount of 4% by weight and at least a peak is present in a range of from 3,000 to 9,000 when measured by Gel Permeation Chromatography. In addition, the binder resin does not include a tetrahydrofuran-insoluble compound and the charge controlling agent is a resin charge controlling agent including at least units obtained from a monomer including a sulfonate group; an aromatic monomer including an electron absorption group; and an acrylic ester and/or a methacrylic ester monomer.

83 Claims, 5 Drawing Sheets

TONER, DEVELOPER, AND IMAGE FORMING METHOD AND APPARATUS

BACKGROUND OF THE INVENTION

1. Field of the Invention

The present invention relates to a toner used for a developer for developing an electrostatic latent image in electrophotographies, electrostatic recording, electrostatic printing, etc., and more particularly to an electrophotographic toner, developer and apparatus used for a copier, laser printer and plain paper facsimile using a direct or indirect electrophotographic image forming method. In addition, the present invention relates to an electrophotographic toner, developer and apparatus used for a full color copier, full color laser printer and full color plain paper facsimile using a direct or indirect electrophotographic image forming method.

2. Discussion of the Background

Typically, a developer used in electrophotography, electrostatic recording and electrostatic printing and the like is adhered to an image bearer such as photoreceptors on which a latent image is formed in a developing process; transferred on a transfer medium such as transfer sheets in a transferring process; and fixed on the transfer sheet in a fixing process. As the developer for developing the latent image formed on the surface of the image bearer, a two-component developer including a carrier and a toner and a one-component developer (magnetic or nonmagnetic toner) which does not need a carrier are known.

In the two-component developing method, toner particles adhere to the surface of the carrier and the developer deteriorates. In addition, the concentration of the toner in the developer decreases since only the toner is consumed, and the mixing ratio of the toner and the carrier has to be maintained at a fixed ratio. Therefore, there is a disadvantage that the developing device is enlarged. On the other hand, the one-component-developing method does not have this disadvantage and the image developer can be downsized, and is now prevailing.

Recently, office automation and colorization in an office are progressing. Opportunities increase, in which not only copies of just letters but also hundreds of copies including graphs, etc. formed by personal computers are produced by printers for presentation. The produced images are mostly solid images, line images and halftone images. In accordance with this trend, market demands for image quality are changing and demands for high reliability of image are further increasing.

Conventionally, there is a magnetic one-component developing method using a magnetic toner and a non-magnetic one-component developing method using a non-magnetic toner in the electrophotographic process using the one-component developer. The magnetic one-component developing method is mostly used for compact printers recently, in which a developer bearer including a magnetic field generating means such as magnets bears a magnetic toner including a magnetic material such as a magnetite, and in which a layer-thickness regulating member forms a thin toner layer on the developer bearer for development.

On the other hand, in the non-magnetic one-component developing method, a toner supply roller is pressed against the developer bearer to supply the toner onto the developer bearer which electrostatically bears the toner and a layer-thickness regulating member forms a thin toner layer on the developer bearer for development. This method has an advantage of being usable for colorization because of not including a colored magnetic material, and is mostly used for compact full color printers recently, which are light-weight and low cost because of not using a magnet in the developer bearer.

However, the one-component developing method still has many points to be improved. The two-component developing method uses a carrier as means of charging and transporting the toner, and the toner and carrier are transported to the developer bearer after they are sufficiently agitated and mixed in the image developer. Therefore, the toner can be stably charged and transported for a long time and the two-component developing method can be easily used for a high-speed developing device.

Compared with the two-component developing method, in the one-component developing method, defective charge and transport of the toner due to a long-time use and high-speed development tend to occur since the method does not have stable charge and transport means like the carrier. Namely, in the one-component developing method, a contact and friction charge time between the toner and friction charge members such as layer-thickness regulating members is so short that the toner having low charge and reverse charge tends to increase more than the toner of the two-component developing method using the carrier.

Particularly in the non-magnetic one-component developing method, in which ordinarily at least one toner transport member transports the toner (developer) and an electrostatic latent image formed on a latent-image bearer is developed by the transported toner, the thickness of the toner layer on the surface of the toner transport member has to be as thin as possible.

This is same for the two-component developing method in which a carrier having quite a small diameter is used. In addition, particularly when a toner having high electric resistance is used as a one-component developer, the thickness of the toner layer has to be significantly thin since the toner has to be charged by the developing device. This is because when the toner layer is too thick, only the surface thereof is charged and the toner layer cannot be uniformly charged. Therefore, the toner needs to have a quicker charge speed and to keep an appropriate charge quantity.

Conventionally, a charge controlling agent is optionally included in a toner in order to stabilize the charge of the toner. The charge controlling agent controls and maintains the friction charge quantity of the toner. Specific examples of the negative charge controlling agents include monoazo dyes, salicylic acids, naphthoic acids, metallic salts and metal complex salts of dicarboxylic acids, diazo compounds, boric complex compounds, etc. Specific examples of the positive charge controlling agents include quaternary ammonium salt compounds, imidazole compounds, nigrosin, azine dyes, etc.

However, many of these charge controlling agents have colors and cannot be used for a color toner. In addition, some of these agents do not have good solubility with a binder resin and the agents on the surface of the toner, which largely affect the charge thereof, easily leave from the surface thereof. Therefore, charge irregularity of the toner, and toner filming over a developing sleeve and a photoreceptor tend to occur. Accordingly, although images having good quality can be produced at the beginning, the image quality gradually changes and background fouling and image irregularity occur. Particularly, when the charge controlling agent is used for a toner for full color copier producing continuous images while the toner is supplied to the copier, the charge quantity of the toner decreases and the color tone becomes noticeably different from that of the initial image. In addition, an image forming unit called as a process cartridge has to be changed quickly only after several thousand images are produced, which is against environment protection and gives troubles to users. Further, most of the units include heavy metals such as chrome and are becoming problems lately in view of safety.

In order to improve the above-mentioned problems, Japanese Laid-Open Patent Publications Nos. 63-88564, 63-184762, 3-56974 and 6-230609 disclose a resin charge controlling agent which improves the solubility with a binder resin, the transparency of a fixed toner image and the safety. Since these resin charge controlling agents have good solubility with the a resin, the resultant toner has good chargeability and transparency. However, these resin charge controlling agents have disadvantages that the resultant toner has less charge quantity and charge speed than the toner using monoazo dyes, salicylic acids, naphthoic acids, metallic salts and metal complex salts of dicarboxylic acids. The chargeability of the toner improves if the addition quantity of the resin charge controlling agent is increased, but the fixability of the toner (low temperature fixability and offset resistance) deteriorates. Further, a toner including the resin charge controlling agent has a charge quantity easily influenced by humidity, and therefore background fouling tends to occur.

Japanese Laid-Open Patent Publications Nos. 8-30017, 9-171271, 9-211896 and 11-218965 disclose a copolymer of a monomer including an organic acid salt such as sulfonate groups and aromatic monomers having an electron absorption group. However, although the resultant toner has sufficient charge quantity because of hygroscopicity and adherence thought to be of the monomer including an organic acid salt such as sulfonate groups, the copolymer is not sufficiently dispersed in a binder resin. Therefore, charge irregularity of the toner, and toner filming over a developing sleeve and a photoreceptor are not sufficiently prevented. In addition, in order to improve the solubility with a binder resin such as styrene resins and polyester resins, a copolymer of a styrene monomer, a monomer including an organic acid salt such as sulfonate groups and an aromatic monomer having an electron absorption group; or a copolymer of a polyester monomer, a monomer including an organic acid salt such as sulfonate groups and an aromatic monomer having an electron absorption group is disclosed. However, the charge quantity of the resultant toner cannot be sufficiently maintained for a long time, and toner filming over a developing sleeve and a photoreceptor are not sufficiently prevented. Particularly, for a polyester resin and a polyol resin preferably used as a binder resin for a full color toner, the above-mentioned copolymer does not have a sufficient effect.

Demands for printers are expanding lately, and downsizing, speeding up of printing and lowering cost of the printers are progressing. Accordingly, high reliability and long life of the printers are beginning to be needed, and a toner capable of maintaining its properties for a long time is needed as well. However, the above-mentioned resin charge controlling agents are unable to maintain the charge controllability, and contaminate a developing sleeve and a developer layer-thickness regulating members such as blades and rollers, resulting in lowering the chargeability of the toner and toner filming over a photoreceptor. In addition, since development has to be performed by a small amount of a developer for a short time due to the downsizing and speeding up of printing, the developer needs to have good chargeability.

SUMMARY OF THE INVENTION

Accordingly, an object of the present invention is to provide an electrophotographic toner and developer, which have a stable charge and transport quantity even when used for a long time, and which produce images having high density and quality without background fouling.

Another object of the present invention is to provide an electrophotographic toner and developer producing more than tens of thousands of images having good quality equivalent to that of the initial image without change of the chargeability of the toner for a two-component developing method in which a layer-thickness regulating member forms a thin layer of two-component developer including a toner and a carrier on a developer bearer (developing sleeve) and a one-component developing method in which a layer-thickness regulating member forms a thin layer of one-component developer on a developer bearer (developing roller).

Yet another object of the present invention is to provide an image forming method and apparatus using the toner and developer.

Briefly these objects and other objects of the present invention as hereinafter will become more readily apparent can be attained by a toner including at least a binder resin; a colorant; and a charge controlling agent, in which the binder comprises a polyester resin having a molecular weight distribution such that components having a molecular weight not greater than 500 are included in an amount of 4% by weight and at least a peak is present in a range of from 3,000 to 9,000 when measured by Gel Permeation Chromatography (GPC), and in which the binder resin does not include a tetrahydrofuran-insoluble compound and the charge controlling agent is a resin charge controlling agent including at least units obtained from a monomer including a sulfonate group; an aromatic monomer having an electron absorption group; and an acrylic ester and/or a methacrylic ester monomer.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
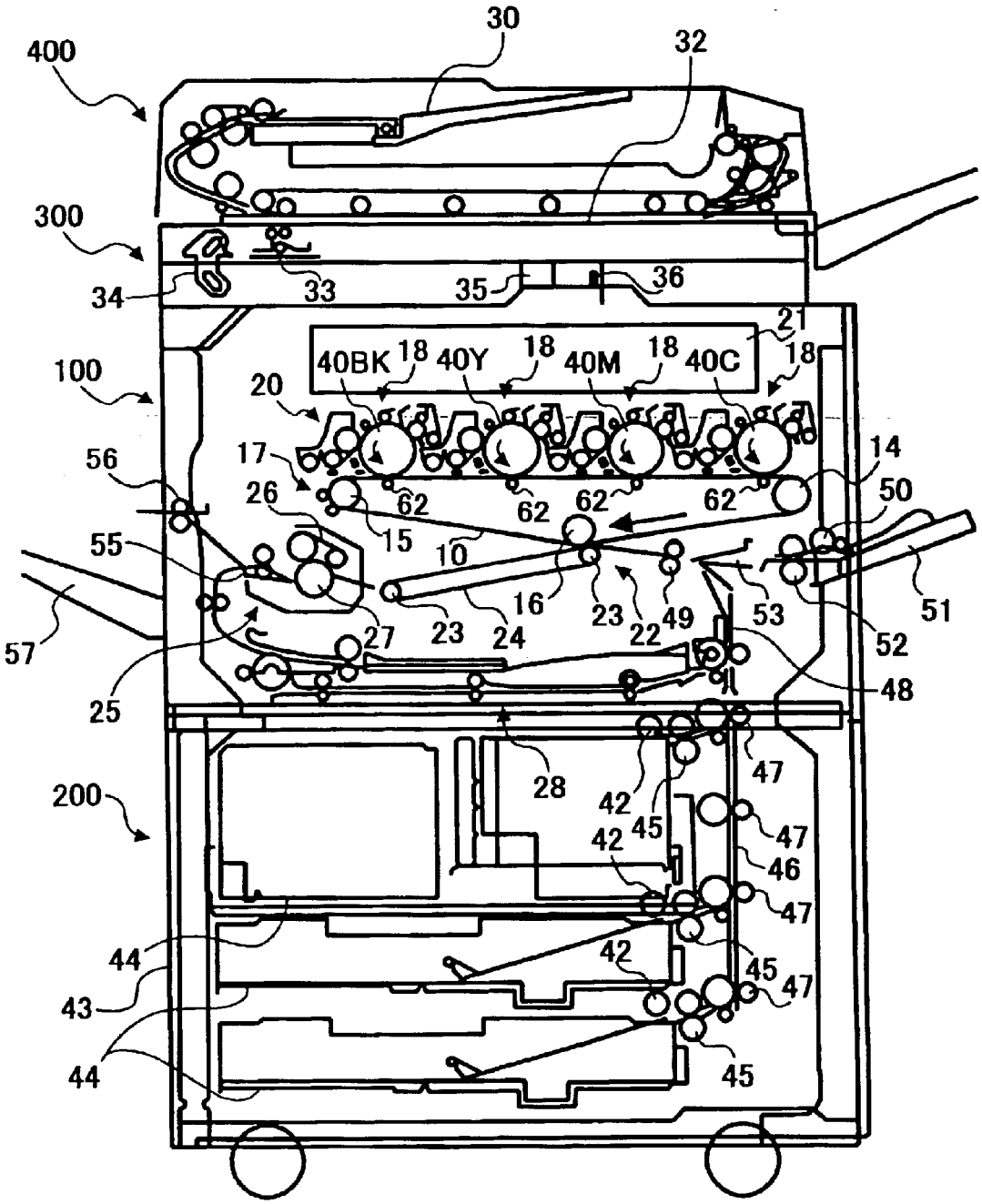
FIG. 1 is a schematic view illustrating an embodiment of the image forming apparatus of the present invention.

Generally, the present invention provides a toner including at least a binder resin which is a polyester resin and a resin charge controlling agent including at least units obtained from a monomer including a sulfonate group; an aromatic monomer having an electron absorption group; and an acrylic and/or a methacrylic ester monomer.

A polyester resin is preferably used for the binder resin, particularly for the color toner of the present invention in view of the colorability and image strength. Since a color image has multiplied toner layers, a crack and defect of image occur due to the deficiency of the toner layer strength and appropriate image gloss is lost. This is because a polyester and polyol resin are used to maintain the appropriate gloss and the strength of the image.

The polyester resin is typically formed by an esterification reaction of polyalcohol and a polycarboxylic acid. Specific examples of alcohol monomers in monomers forming the polyester resin of the present invention include diol such as ethylene glycol, diethylene glycol, triethylene glycol, 1,2-propylene glycol, 1,3-propylene glycol, 1,4-butadieneol, neo-pentyl glycol, 1,4-butenediol, 1,5-pentanediol and 1,6-hexanediol; adducts of a bisphenol A such as bisphenol A, hydrogenated bisphenol A and polyoxyproplylene modified bisphenol A with an alkylene oxide; and other dihydric alcohol; or sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene and other polyalcohol having three or more hydroxyl groups.

Among these monomers, the adducts of a bisphenol A with an alkylene oxide are preferably used. The adducts of a bisphenol A with an alkylene oxide can form polyester having a high glass transition point because of the properties of the skeleton of bisphenol A, and the resultant toner has good copy blocking resistance and heat resistance. In addition, bilateral alkyl groups of the skeleton of bisphenol A work as a soft segment in a polymer, and the resultant toner has good colorability and strength when the toner image is fixed. Particularly, the adducts of a bisphenol A with an alkylene oxide having an ethylene or a propylene group are preferably used.

Specific examples of acid monomers in monomers forming the polyester resin of the present invention include alkenyl or alkyl succinic acids such as maleic acids, fumaric acids, citraconic acids, itaconic acids, glutaconic acids, phthalic acids, isophthalic acids, terephthalic acids, cyclohexane dicarboxylic acids, succinic acids, adipic acids, sebacic acids, azelaic acids, malonic acids or n-dodecenylsuccinic acids and n-dodecylsuccinic acids; their anhydrides, alkyl ester and other dihydric carboxylic acids; and 1,2,4-benzenetricarboxylic acids, 2,5,7-naphthalenetricarboxylic acids, 1,2,4-naphthalenetricarboxylic acids, 1,2,4-butanetricarboxylic acids, 1,2,5-hexanetricarboxylic acids, 1,3-dicarboxyl-2-methyl-methylenecarboxypropane, tetra (methylenecarboxyl)methane, 1,2,7,8-octantetracarboxylic acids, empol trimer acids and their anhydrides, alkyl ester, alkenyl ester, aryl ester and other carboxylic acids having three or more hydroxyl groups.

Specific examples of the above-mentioned alkyl groups, alkenyl groups or aryl esters include 1,2,4-benzenetricarboxylic acids, 1,2,4-trimethyl benzenecarboxylic acids, 1,2,4-triethyl benzenecarboxylic acids, 1,2,4-tri-n-octylbenzenecarboxylic acids, 1,2,4-tri-2-ethylhexyl benzenecarboxylate, 1,2,4-tribenzyl benzenecarboxylate, 1,2,4-tris(4-isopropylbenzyl)benzenecarboxylate, etc.

A manufacturing method of forming the polyester of the present invention is not limited, and the esterification reaction can be performed by known methods. An ester exchange reaction can be performed by known methods, and known ester exchange catalysts such as magnesium acetate, zinc acetate, manganese acetate, calcium acetate, tin acetate, lead acetate and titaniumtetrabutoxide can be used. A polycondensation reaction can be performed by known methods, and known polymerization catalysts such as antimony trioxide and germanium dioxide can be used.

The binder resin of the present invention is particularly characterized in that it does not include THF-insoluble components, a content of its components having a molecular weight not greater than 500 is not greater than 4% by weight in a molecular weight distribution when measured by GPC, and that it has a peak at least in a molecular weight range of from 3,000 to 9,000. The glossiness as well as transparency of the resultant toner deteriorates if the binder resin has a THF-insoluble component, and particularly a quality image cannot be produced on an OHP sheet. When a content of the components having a molecular weight not greater than 500 is greater than 4% by weight, a blade and sleeve of an image developer are contaminated by a long-time use and toner filming tends to occur.

The GPC of the present invention is measured as follows:

(1) a column is stabilized in a heat chamber having a temperature of 40° C.;

(2) THF is put into the column at a speed of 1 ml/min as a solvent;

(3) 200 $\mu$l of the THF liquid-solution sample including the mother toner having a concentration of from 0.05 to 0.6% by weight, from which THF-insoluble components are removed by a filter having 0.45 $\mu$m screen mesh is put into the column; and (4) the molecular weight distribution of the sample is determined by using a calibration curve which is previously prepared using several polystyrene standard samples having a single distribution peak, and which shows the relationship between a count number and the molecular weight.

As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 kinds of the standard polystyrene samples. In addition, an RI (refraction index) detector is used as the detector.

In addition, whether the binder resin includes THF-insoluble components is determined when the THF liquid solution sample is formed to measure the molecular weight distribution. Namely, when the THF liquid-solution is discharged from a syringe with a 0.45 $\mu$m filter at its end, it is determined that there is no THF-insoluble component if the filter is not clogged.

The binder resin of the present invention is also characterized by having its endothermic peak in a temperature range of from 60 to 70° C. when measured by a differential scanning calorimeter. Preservability of the resultant toner deteriorates if the peak is less than 60° C. Productivity of the toner deteriorates if greater than 70° C. The endothermic peak of the present invention is measured by Rigaku THERMOFLEX TG 8110 manufactured by RIGAKU Corp. at a programming rate of 10° C./min, and the maximum peak of the endothermic curve is determined to be the endothermic peak.

In addition, the binder resin of the present invention preferably has a ratio between its weight average molecular weight (Mw) and number average molecular weight (Mn), i.e., Mw/Mn of from 2 to 10. The resultant toner does not have sufficient gloss and a glossy quality image cannot be produced if Mw/Mn is greater than 10. When Mw/Mn is less than 2, the productivity of pulverizing process for manufacturing a toner deteriorates and a blade and sleeve of an image developer are contaminated by a long-time use and toner filming tends to occur.

The binder resin of the present invention is characterized as well by having an acid value not greater than 20 KOH mg/g. It is known that relationship between chargeability and acid value of the polyester resin is proportional and that the greater the acid value, the greater the negative chargeability of the resin. At the same time, the acid value of the resin affects the charge stability of the resultant toner. Namely, when the acid value is high, the charge quantity of the toner increases under a low temperature and low humidity and decrease under a high temperature and high humidity. Therefore, change of background fouling, image density and color reproducibility of the resultant toner becomes large, and a high quality image is difficult to maintain. When the acid value is greater than 20 KOH mg/g, the charge quantity of the toner increases and the environmental resistance thereof deteriorates. The polyester resin of the present invention preferably has an acid value not greater than 20 KOH mg/g, and more preferably not greater than 5 KOH mg/g.

Further, the binder resin of the present invention is characterized by having an apparent viscosity of $10^4$ Pa·S at a temperature of from 95 to 120° C. when measured by a flow tester. When the apparent viscosity is $10^4$ Pa·S at less than 95° C., hot offset resistance when the a toner image is fixed deteriorates. When greater than 120° C., the toner does not have sufficient gloss.

The temperature at which the apparent viscosity becomes $10^4$ Pa·S is measured by a flow tester CFT-500 manufactured by Shimadzu Corp. under the following conditions:

pressure: 10 kg/cm$^2$;

orifice size: 1 mm×1 mm; and programming rate: 5° C./min.

As a monomer including a sulfonate group forming the resin charge controlling agent of the present invention, there are monomers including an aromatic sulfonate group, monomers including aliphatic sulfonate group, etc.

Specific examples of the monomers including an aromatic sulfonate group include alkali metallic salts such as vinyl sulfonic acids, acrylic vinyl sulfonic acids, 2-acrylamide-2methylpropanesulfonic acids and methacryloyloxyethylsulfonic acids; alkali earth metallic salts; amine salts; quaternary ammonium salts, etc.

Specific examples of the monomers including an aliphatic sulfonate group include alkali metallic salts such as styrene sulfonic acids, sulphophenyl acrylamide, sulphophenyl maleimide and sulphophenyl itaconimide; alkali earth metallic salts; amine salts; quaternary ammonium salts, etc. Heavy metal such as nickel, copper, mercury and chrome salts are not preferably used in view of safety.

Specific examples of the aromatic monomers having an electron absorption group include styrene substituents such as chlorostyrene, dichlorostyrene, bromostyrene, fluorostyrene, nitrostyrene and cyanestyrene; phenyl(metha) acrylate substituents such as chlorophenyl(metha)acrylate, bromophenyl(metha)acrylate, nitrophenyl(metha)acrylate and chlorophenyloxyethyl(metha)acrylate; phenyl(metha) acrylamide substituents such as chlorophenyl(metha) acrylamide, bromophenyl(metha)acrylamide and nitrophenyl(metha)acrylamide; phenylmaleimide substituents such as chlorophenylmaleimide, dichlorophenylmaleimide, nitrophenylmaleimide and nitrochlorophenylmaleimide; phenylitaconimide substituents such as chlorophenylitaconimide, dichlorophenylitaconimide, nitrophenylitaconimide and nitrochlorophenyitaconimide; and phenylvinylether substituents such as chlorophenylvinyl ether, and nitrophenylvinyl ether. Particularly, phenylmaleimide substituents and phenylitaconimide substituents substituted by a chlorine atom or a nitro group are preferably used because the resultant toner has good chargeability and filming resistance.

Specific examples of the acrylic esters and/or methacrylic ester monomers include methyl(metha)acrylate, ethyl (metha)acrylate, propyl(metha)acrylate, n-butyl(metha) acrylate, isobutyl(metha)acrylate, stearyl(metha)acrylate, dodecyl(metha)acrylate, 2-ethylhexyl(metha)acrylate, etc.

When the units obtained from monomers including a sulfonate group is included in the resin charge controlling agent of the present invention, negative charging capability thereof is improved. However, since the monomer including a sulfonate group is hygroscopic, the stability against environment (temperature and humidity) of the resultant toner deteriorates. Then, it is known that the monomer including a sulfonate group is used together with an aromatic monomer having an electron absorption group as a copolymer. In such a case, thousands of images can be produced without problems, but when tens of thousands of images are produced in a long term, a developing sleeve and layer-thickness regulating members (blade and roller) of an image developer are contaminated; toner filming over a photoreceptor occurs; the charge stability of the resultant toner and high quality images are not sufficiently maintained; and the productivity of the toner deteriorates.

In order to cover such drawbacks, when a copolymer including at least three kinds of monomer, i.e., the monomer including a sulfonate group; the aromatic monomer having an electron absorption group; and the acrylic ester and/or methacrylic ester monomer, is used as a resin charge controlling agent for a polyester resin or polyol resin which is preferably used as a binder resin for a full-color toner in view of colorability and image strength of the resultant toner, a toner having the following properties for a long period of time can be obtained:

good chargeability;

good environmental stability;

not contaminating a developing sleeve and developer layer-thickness regulating members (blade and roller);

not filming over a photoreceptor;

good thin layer formability;

maintaining high quality image; and good productivity;

These effects are presumed to come from the following reasons:

combination of the monomer including a sulfonate group and aromatic monomer having an electron absorption group increase negative charging capability of the resin charge controlling agent;

the acrylic ester and/or methacrylic ester monomer further increase charge stability of the resultant toner against environment and increase hardness of the resin to improve pulverizability of the resultant toner, which prevents the contamination of a developing sleeve and layer-thickness regulating members and the toner filming over a photoreceptor; and combination with a polyester resin improves dispersibility of the resultant toner which has a sharp charge quantity distribution.

A content of units obtained from the monomer including a sulfonate group of the present invention is from 1 to 30%, and preferably from 2 to 20% by weight per 100% of the resin charge controlling agent. When the content of the unit obtained from the monomer including a sulfonate group is less than 1% by weight, charge build-up and quantity of the resultant toner is insufficient, resulting in image deterioration. When greater than 30% by weight, charge stability of the resultant toner against environment deteriorates, and the charge quantity is low under a high temperature and high humidity and high under a low temperature and low humidity. In addition, the contamination of a developing sleeve and layer-thickness regulating members, and the toner filming over a photoreceptor tend to occur. Further, productivity of the toner in mixing and pulverizing processes deteriorates.

A content of units obtained from the aromatic monomer having an electron absorption group is from 1 to 80%, and preferably from 20 to 80% by weight. When the content of the unit obtained from the aromatic monomer having an electron absorption group is less than 1% by weight, charge quantity of the resultant toner is insufficient, and background fouling and toner scattering tend to occur. When greater than 80% by weight, the resultant charge controlling agent is not dispersed well in a toner and charge quantity distribution of the resutant toner becomes wide. Therefore, background fouling and toner scattering tend to occur, and high quality images are difficult to maintain.

A content of units obtained from the acrylic ester and/or methacrylic ester monomer is from 10 to 80%, and preferably from 20 to 70% by weight. When the content is less than 10% by weight, the resultant toner does not have sufficient charge stability against environment and pulverizability in kneading and pulverizing processes when the toner is manufactured. In addition, the resultant toner sufficiently prevents neither contamination of a developing sleeve and developer layer-thickness regulating members nor toner filming over a photoreceptor. When greater than 80%, charge build-up and quantity of the resultant toner is insufficient, resulting in image deterioration.

When these resin charge controlling agents are used in combination with a polyester or polyol resin which are suitable binder resins for a full-color toner in respect of colorability and image strength, they have appropriate dispersibility and the resultant toner has a sharp charge quantity distribution. In addition, the toner has good charge stability and high quality images are produced for a long time The resin charge controlling agent of the present invention preferably has an apparent viscosity of $10^4$ Pa·S when measured by a flow tester at a temperature of from 85 to 110° C. When the temperature is less than 85° C., the charge controlling agent does not have appropriate dispersibility, and the resultant toner is not only sufficiently charged but also tends to be agglomerated and have poor storage stability. In addition, the productivity of the toner in a pulverizing process deteriorates because the toner particles tend to be agglomerated. When greater than 110° C., the dispersibility of the agent deteriorates and the resultant toner has a wide charge distribution, resulting in occurrence of background fouling and toner scattering. Further, the toner has poor fixability and particularly poor colorability when color toners are multiplied. The temperature at which the apparent viscosity becomes $10^4$ Pa·S is measured by a flow tester CFT-500 manufactured by Shimadzu Corp. under the following conditions:

pressure: 10 kg/cm$^2$;

orifice size: 1 mm×1 mm; and programming rate: 5° C./min.

The resin charge controlling agent of the present invention preferably has a number average molecular weight of from 1,000 to 10,000. When less than 1,000, the agent does not have appropriate dispersibility in a toner, the resultant toner is not only sufficiently charged but also the productivity of the toner deteriorates because the toner particles tend to be agglomerated in a pulverizing process. When greater than 10,000, the dispersibility of the agent in a toner deteriorates and the resultant toner has a wide charge distribution. Therefore, background fouling and toner scattering tend to occur, and the toner has poor fixability and colorability. When a temperature at which the binder resin of the present invention has an apparent viscosity of $10^4$ Pa·S when measured by a flow tester is $T_1$ and a temperature at which the resin charge controlling agent has $10^4$ Pa·S is $T_2$, $T_1$ and $T_2$ preferably satisfy the following relationship:

$$0.9<T_1/T_2<1.4$$

Dispersion of a charge controlling agent in a binder resin is a large factor to determine chargeability of the resultant toner. In the present invention, a toner having good chargeability and charge build-up can be obtained by a combination of a specific binder resin and a specific resin charge controlling agent. However, it is apparent as mentioned above, that dispersibility of the resin charge controlling agent in the binder resin affects chargeability of the resultant toner.

The present inventors have an eye on the respective apparent viscosity when measured by a flow tester of the binder resin and the resin charge controlling agent, and specify the dispersibility thereof as well. When $T_1/T_2$ is less than 0.9, the apparent viscosity of the binder resin and the resin charge controlling agent are close to each other, and they are soluble each other. Therefore, the resultant toner is short of the saturated charge quantity and has poor charge build-up. When $T_1/T_2$ is greater than 1.4, difference of the apparent viscosity of the binder resin and the resin charge controlling agent is too large, and the resin charge controlling agent is not well dispersed in the binder resin. Therefore, background fouling of early date and deterioration of chargeability of the resultant toner as time passes occur.

The content of the resin charge controlling agent of the present invention is preferably from 0.1 to 20%, and more preferably from 0.5 to 10% by weight per 100% of the mother toner. When less than 0.1% by weight, the resultant toner does not have sufficient charge build-up and quantity. Therefore, background fouling and toner scattering tend to occur. When greater than 20% by weight, the agent is not dispersed well and charge quantity of the resultant toner becomes wide. Therefore, background fouling and toner scattering tend to occur.

Any known dyes and pigments can be used as the colorant of the present invention. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, Benzimidazolone Yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Carmine 6B, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These colorants are used alone or in combination.

Among these colorants, a colorant classified as C.I. Pigment Yellow 180 such as Benzimidazolone Yellow is preferably used as a yellow colorant because the colorant has an effect of generating charge. A toner including the colorant and not a charge controlling agent has the same charge quantity as that of a toner including a charge controlling agent, although the charge maintaining capability of the toner including the colorant and not a charge controlling agent is lower than that of the toner including a charge controlling agent.

In addition, a magenta colorant such as Carmine 6B and Brilliant Carmine 6B having the following formula (1) is preferably used in the present invention.

(1)

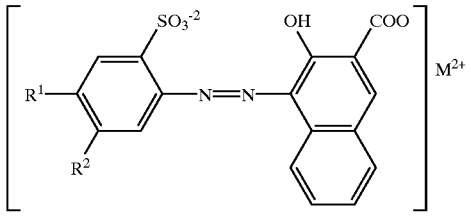

wherein $R^1$ and $R^2$ are independently a group selected from a group consisting of a hydrogen atom, an alkyl group, a phenyl group and a halogen atom; and M is one of Ba, Ca, Sr, Mn and Mg.

This is because when the colorant is used together with the polyester resin as the binder resin and the resin charge controlling agent of the present invention, the dispersibility of the colorant in the resin and the chargeability of the resultant toner are improved. In addition, the resultant toner has further improved transparency and color reproducibility, and images having stable image quality can be produced for a long time even when a toner having a small particle diameter is used. The reason is not clarified yet, however, it is thought that the colorant is a soluble azo pigment including a soluble group such as carboxyl groups and sulfonate groups and that an interaction thereof with a carboxyl group and a hydroxyl group in the polyester resin gives a considerably high effect to the dispersibility of the colorant.

The content of the colorant in the toner is preferably from 0.1 to 50 parts by weight per 100 parts by weight of the binder resin included in the toner.

In the present invention, known charge controlling agents may be optionally used together with the resin charge controlling agent. Specific examples of the charge controlling agents include Nigrosine dyes, triphenylmethane dyes, metal complex dyes including chromium, chelate compounds of molybdic acid, Rhodamine dyes, alkoxyamines, quaternary ammonium salts, fluorine-modified quaternary ammonium salts, alkylamides, phosphor or compounds including phosphor, tungsten or compounds including tungsten, metallic salts of salicylic acid derivatives, etc.

The toner preferably includes a wax to improve the releasability thereof. Suitable waxes for use in the toner include waxes having a melting point of from 40 to 120° C. and preferably from 50 to 110° C. When the melting point of the wax included in the toner is too high, the low temperature fixability of the resultant toner deteriorates. To the contrary, when the melting point is too low, the offset resistance and durability of the resultant toner deteriorate.

The melting point of waxes can be determined by a method using a differential scanning calorimeter. Namely, a few milligrams of a sample is heated at a constant heating speed (for example, 10° C./min) to determine the temperature at which the sample begins to melt.

Specific examples of the waxes include solid paraffin waxes, microcrystalline waxes, rice waxes, fatty acid amide waxes, fatty acid waxes, aliphatic monoketones, fatty acid metal salt waxes, fatty acid ester waxes, partially-saponified fatty acid ester waxes, silicone varnishes, higher alcohols, carnauba waxes, polyolefins such as low molecular weight polyethylene and polypropylene, and the like waxes. In particular, polyolefins preferably having a softening point of from 70 to 150° C., and more preferably from 120 to 150° C., which is determined by a ring and ball method, are preferably used.

The toner may include a cleanability improver to remove the residual developer on a photoreceptor and a first transfer medium even after a toner image is transferred. Specific examples of such a cleanability improver include fatty acids and their metallic salts such as stearic acid, zinc stearate, and calcium stearate; and polymer fine particles such as polymethylmethacrylate and polystyrene, which are manufactured by a method such as soap-free emulsion polymerization methods. The polymer fine particles having relatively a narrow particle diameter distribution and a volume average particle diameter of from 0.01 to 1 $\mu$m are preferably used in the toner of the present invention.

The toner of the present invention may include other additives, e.g., colloidal silica; hydrophobizing silica; teflon; fluoropolymers; low molecular weight polyolefin; fatty acid metallic salts such as zinc stearate, aluminium stearate and calcium stearate; metal oxides such as titanium oxide, aluminium oxide, tin oxide and stibium oxide; electroconductivity imparting agents such as carbon black and tin oxide; magnetic materials; their surface-treated materials, etc. These additives can be used alone or in combination, and the content thereof is from 0.1 to 10 parts by weight per 100 parts by weight of the toner.

The toner of the present invention may be a magnetic toner including a magnetic material. Specific examples of the magnetic materials include iron oxides such as magnetite, ferrite and hematite; metals such as iron, cobalt and nickel; and alloyed metals or mixtures of these metals and aluminium, cobalt, copper, magnesium, tin, zinc, stibium, beryllium, bismuth, calcium, cadmium, manganese, selenium, titanium, tungsten, vanadium, etc. These magnetic materials preferably have a volume average particle diameter of from about 0.1 to 2 μm, and the content thereof is 5 to 150 parts by weight per 100 parts by weight of the binder resin.

The toner of the present invention may be used together with a carrier as a two-component developer. Any conventional carriers, e.g., iron powders, ferrite, magnetite, glass beads, etc. can be used. In addition, these carriers may be coated with a resin. Known resins such as polyfluorocarbon, polyvinyl chloride, polyvinylidene chloride, phenol resins, polyvinyl acetal, acrylic resins and silicone resins can be used, and a silicone coated carrier is preferably used because the resultant developer has a long life. In addition, electroconductive powders may be included in the coated resin. As the electroconductive powders, metallic powders, carbon black, titanium oxide tin oxide, zinc oxide, etc. can be used. These electroconductive powders preferably have an average particle diameter not greater than 1 μm. The average particle diameter is greater than 1 μm, control of the electric resistance is difficult. The content of the toner in a two-component developer is typically 0.5 to 20 parts by weight per 100 parts by weight of the carrier.

Any known methods may be used for manufacturing the toner of the present invention, i.e., manufacturing methods including a process of mechanically mixing developer components including at least a binder resin, a charge controlling agent and a pigment; a process of kneading the mixture upon application of heat; a process of pulverizing the mixture; and a process of classifying the pulverized mixture, can be used. In addition, a manufacturing method is included, in which powders besides the specified product, produced in a pulverizing or classifying process are reused for a mechanical mixing and kneading process.

The powders besides the specified product (by-product) means fine and coarse particles produced in the pulverizing or classifying process after the kneading process, whose particle diameters are out of desired diameter.

1 to 20 parts by weight of such a by-product are preferably mixed with 100 parts by weight of the main material in the mixing or kneading process. A mechanical mixing process of mixing at least a binder resin, a charge controlling agent, a pigment and a by-product can be performed by a conventional mixer having a rotating blade under a conventional condition, and not particularly limited.

In the kneading process following the mixing process, the mixture is contained in a kneader and then kneaded upon application of heat. Suitable kneaders include the kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG.

In the kneading process, it is important to control the kneading conditions so as not to cut the molecular chains of the binder resin used in the toner. Specifically, when the mixture is kneaded at a temperature much lower than the softening point of the binder resin used, the molecular chains of the binder resin tend to be cut. When the kneading temperature is too high, the pigment in the mixture cannot be fully dispersed.

In the pulverizing process, it is preferable that the kneaded mixture is at first crushed to prepare coarse particles (hereinafter referred to as a crushing step) and then the coarse particles are pulverized to prepare fine particles (hereinafter referred to as a pulverizing step). In the pulverizing step, a pulverizing method in which coarse particles are pulverized by being collided against a collision plate by jet air or a pulverizing method in which coarse particles are pulverized at a narrow gap between a mechanically rotating rotor and a stator is preferably used. After the pulverizing process, the powder is air-classified using centrifugal force to obtain toner particles (i.e., a mother toner) having a predetermined average particle diameter, for example, from 5 to 20 μm.

Then the mother toner may be mixed with the external additive of the present invention to improve the fluidity, developability and transferability.

Suitable mixers include known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used.

Specific examples of the mixers include V-form mixers, locking mixers, Loedge Mixers, Nauter Mixers, Henshel Mixers and the like mixers.

The toner and the developer of the present invention are filled in a container when they are used in an image forming apparatus, and it is typical that particularly the container filled with the toner is separately distributed and equipped with the apparatus by the user for forming an image. The above-mentioned container is not limited and any containers can be used besides conventional bottles, cartridge type containers, or gazette packs for the developer.

It was found that when the color toner of the present invention is filled in a container such as toner cartridges, the adherence of the toner onto the internal surface of the container is less than that of a conventional toner, and that the toner has good dischargeability and discharging stability. Further, it was found that when a container filled with the toner of the present invention is collected from the market and recycled, the container is easily cleaned and handled.

In addition, it was also found that when a two-component developer including the toner of the present invention and a carrier is filled in a container such as gazette packs, the adherence of the toner onto the internal surface of the container is less than that of a conventional developer, and that the toner scattering scarcely occurs. Therefore, the container is easily handled by the user and the service man, and easily disposed.

Next, the image forming apparatus of the present invention will be explained. The image forming apparatus is not limited if it is an apparatus forming an image by an electrophotographic method such as copiers, printers and facsimiles.

FIG. 1 is a schematic view illustrating an embodiment of the image forming apparatus of the present invention. The apparatus is formed of an image forming apparatus unit 100 (printer portion), paper feeding table 200 (paper feeding portion), scanner 300 installed on the apparatus 100 (scanner portion) and an automatic original transferer (ADF) 400 on the scanner portion (original transfer portion). In addition, a control portion controlling performance of each device in the apparatus is also equipped with the apparatus (not shown).

The scanner portion 300 reads the image information of an original put on a contact glass 32 with a reading sensor 36 and transfers the information to the control portion. The control portion controls the laser and light emitting diode (not shown) arranged in a irradiator 21 in the printer portion 100 and irradiates an imagewise light to photoreceptors 40Bk, 40Y, 40M and 40C based on the information transferred from the scanner portion 300. A latent image is formed on each photoreceptor 40Bk, 40Y, 40M and 40C by the irradiation and the latent image is developed to a toner image through a predetermined developing process.

The printer portion 100 has a first transferer 62, a second transfer 22, a fixer 25 and a deliverer 56 and a toner supplier (not shown), etc. besides the irradiator 21. The above-mentioned developing process will be explained later.

The paper feeding portion 200 has multiplied paper feeding cassettes 44 in a paper bank 43, a paper feeding roller 42 feeding a transfer sheet (P), i.e., an image bearer, from the paper feeding cassettes, a separation roller 45 separating and transferring the transfer sheet P to the paper feeding route 46, a transfer roller 47 transferring the transfer sheet P to a paper feeding route 48 in the printer portion 100, etc. In the embodiment of the image forming apparatus of the present invention, a paper can be manually fed besides the paper feeding portion, and the apparatus also has a manual feeding tray 51 and a separation roller 52 separating and transferring the transfer sheet P on the manual feeding tray to a paper feeding route 53 on the side. A registration roller 49 discharges only one sheet of the transfer sheet P put on the paper feeding cassettes or manual feeding tray 51, and transfer the sheet to a second transfer nip portion between a intermediate transfer belt 10 as an intermediate transfer medium and the second transferer 22.

When a color image is produced in the image forming apparatus, an original is set on an original table 30 or on the contact glass 32 of the scanner portion 300 by opening the original transfer portion 400, and the original is pressed by closing the original transfer portion 400. When a starting switch (not shown) is turned on, the scanner portion activates after the original is transferred onto the contact glass 32 when the original is set in the original transfer portion 400 or immediately when the original is set on the contact glass 32, and drives a first traveler 33 and a second traveler 34. The traveler 33 emits light from the light source and reflects the reflected light from the original toward the second traveler 34. The traveler 34 reflects the light with the mirror to the reading sensor 36 through an image forming lens for the scanner portion 300 to read the image information.

When the image forming apparatus receives the image information from the scanner portion 300, the laser writing as mentioned above and an after-mentioned developing process are performed to form a toner image on each photoreceptor 40Bk, 40Y, 40M and 40C, and one of the four registration rollers drives to feed the transfer sheet P in proportion to the size of the image information.

Subsequently, a drive motor (not shown) rotates one of support rollers 14, 15 and 16, and the other two rollers are rotated in accordance with the roller driven by the motor to drive the intermediate transfer belt 10. At the same time, an individual image forming unit 18 rotates the photoreceptor drums 40Bk, 40Y, 40M and 40C and forms a single color image of black, yellow, magenta and cyan on each photoreceptor, and the single color images are transferred in order on the intermediate transfer belt 10 to form a composite color image thereon.

On the other hand, one of the paper feeding rollers 42 in the paper feeding portion 200 is selectively rotated to pick up the transfer sheets P from one of the paper feeding cassettes 44, and the separation roller 45 separates the transfer sheets one by one and transfer the transfer sheet to the paper feeding route 46. The transfer roller 47 leads the transfer sheet to the paper feeding route 48 in the image forming apparatus unit 100 and the transfer sheet is stopped against the registration roller 49. Alternatively, a paper feeding roller 50 is rotated to pick up the transfer sheets P on the manual feeding tray 51. The separation roller 52 separates the transfer sheets one by one and transfers the transfer sheet to the paper feeding route 53, and the transfer sheet is stopped against the same registration roller 49.

Then, the registration roller 49 is timely rotated when the composite color image is formed on the intermediate transfer belt 10 to transfer the transfer sheet P to the second transfer nip portion which is a contact point of the intermediate transfer belt 10 and a second transfer roller 23, and the color image is secondly transferred onto the transfer sheet P by the electric field formed in the nip and the pressure between the intermediate transfer belt and the second transfer roller.

The transfer sheet P after the image transfer is transferred to the fixer 25 by a transfer belt 24 of the second transferer. After the toner image is fixed on the transfer sheet by a pressure of the pressure roller 27 and a heat in the fixer 25, the transfer sheet is delivered on a delivery tray 57 by a delivery roller 56.

Figure 2:
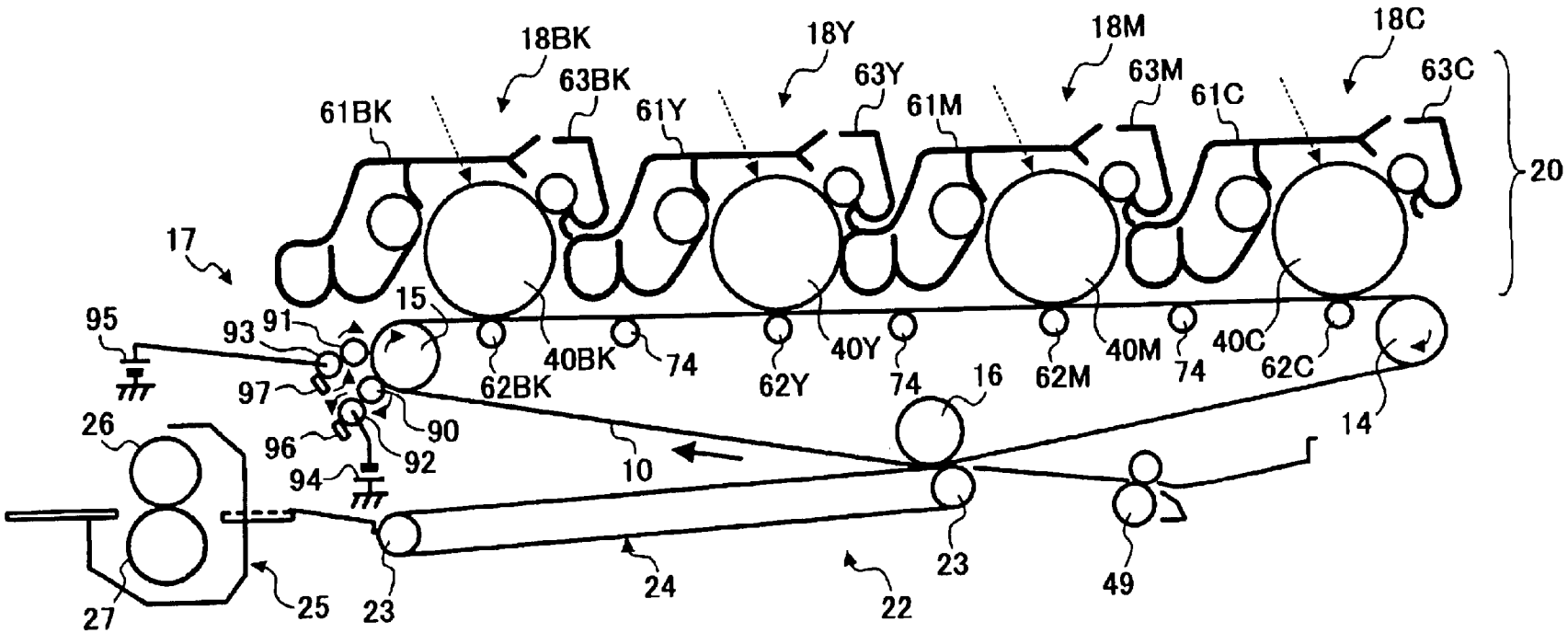
FIG. 2 is a schematic enlarged view illustrating the main part of an embodiment of the printer portion of the present invention.

Next, the details of the printer portion 100 will be explained. FIG. 2 is a schematic enlarged view illustrating the main part of the printer portion 100. The printer portion 100 has the intermediate transfer belt 10 as an intermediate transfer medium supported by the three support rollers 14, 15 and 16, four photoreceptor drums 40Bk, 40Y, 40M and 40C arranged to face the intermediate transfer belt as latent-image bearers bearing one of color toner images of black, yellow, magenta and cyan respectively and developing units 61Bk, 61Y, 61M and 61C to form toner images on the surface of the photoreceptor drums. Further the printer portion 100 has photoreceptor cleaners 63Bk, 63Y, 63M and 63C as well to remove the residual toner on the surface of the photoreceptor drums after the first transfer. A tandem-type image forming device 20 is formed of the plural photoreceptor drums 40Bk, 40Y, 40M and 40C, the developing units 61Bk, 61Y, 61M and 61C and the photoreceptor cleaners 63Bk, 63Y, 63M and 63C.

On the left of the support roller 15, a belt cleaner 17 is arranged to remove the residual toner on the intermediate transfer belt after the toner image is transferred onto the transfer sheet. The belt cleaner 17 has two fur brushes 90 and 91 as cleaning members which are arranged to contact the intermediate transfer belt 10 and rotate in the reverse direction of the rotating direction thereof.

The specifications of the fur brush are, for example, as follows:

Diameter: 20 mm

Material: Acrylic carbon

Fur Girth: 6.25 D/F

Fur Quantity: 100,000/inch$^2$

Electric resistance: $1\times10^7$ Ω

Different polar bias is applied to the fur brushes 90 and 91 respectively from an electric source (not shown). Metallic rollers 92 and 93 are arranged to contact the fur brushes and rotatable in the forward or reverse direction of the fur brushes.

Negative electricity is applied from an electric source 94 to the metallic roller 92 in the upstream of the rotating direction of the intermediate transfer belt 10, and positive electricity is applied from an electric source 95 to the metallic roller 93 in the downstream thereof. The ends of blades 96 and 97 contact the metallic rollers 92 and 93.

In accordance with the rotation of the intermediate transfer belt 10 in a direction indicated by an arrow, the fur blush 90 in the upstream, for example, which is applied with an negative bias cleans the surface of the intermediate transfer belt 10. When the metallic roller 92 is applied with −700 V, the fur blush 90 has −400 V and a positive toner on the intermediate transfer belt 10 can be transferred to the fur blush 90. The toner transferred to the fur blush is further transferred to the metallic roller 92 due to the difference of the potential, and is scraped off by the blade 96.

Thus, the fur blush 90 removes the toner on the intermediate transfer belt 10, however, much quantity of the toner still remains thereon. The toner is negatively charged by the negative bias applied to the fur blush 90. This is considered that the toner is charged by being charged or discharging. Next, the fur blush 91 in the downstream, which is applied with a positive bias removes the toner. The removed toner is transferred to the metallic roller 93 from the fur blush 91 due the difference of the potential, and is scraped off by the blade 97. The toner scraped off by the blades 96 and 97 is collected in a tank (not shown). The toner may be returned to the image developer 61 using a toner recycler mentioned later.

Although almost all the toner is removed from the surface of the intermediate transfer belt 10 after cleaned by the fur blush 90, however, slightly a little toner still remains thereon.

The residual toner on the intermediate transfer belt 10 is positively charged by the positive bias applied to the fur blush 91 as mentioned above. The positively charged toner is transferred to the photoreceptor drums 40Bk, 40Y, 40M and 40C by the transfer electric field applied to the toner at the position of the first transfer, and can be collected by the photoreceptor cleaners 63Bk, 63Y, 63M and 63C.

On the other hand, the second transferer 22 is arranged on the other side of the tandem-type image forming device 20 beyond the intermediate transfer belt 10. The second transferer 22 has the second transfer belt 24 between the two rollers 23 and is arranged to be pressed against a support roller 16 through the intermediate transfer belt 10, and forms the second transfer nip portion to secondly transfer the color toner image on the intermediate transfer belt 10 onto the transfer sheet. The residual toner on the intermediate transfer belt 10 is removed by the cleaner 17 after the second transfer, and the intermediate transfer belt 10 stands ready for another image formation of the tandem-type image forming apparatus 20.

The second transferer 22 has a transfer function to transfer the transfer sheet P to the fixer 25 after the toner image is transferred. A transfer roller and a non-contact charger may be arranged in the second transferer 22, and in such a case, it is difficult therefor to have the transfer function to transfer the transfer sheet P together.

The registration roller 49 is typically earthed, however, a bias can be applied thereto to remove the paper powder of the transfer sheet P. For example, the bias is applied using an electroconductive rubber roller. The diameter of the roller is 18 mm and the surface thereof is covered by an electroconductive NBR rubber having a thickness of 1 mm. The electric resistance is about $1\times10^{10}$ Ω·cm, and about −800 V is applied to a side of the transfer sheet P, onto which the toner is transferred. In addition, +200 V is applied to the other side of the transfer sheet P.

Generally, since the paper powder is not moved to the photoreceptor in the intermediate transfer method, the paper powder transfer need not be considered and the registration roller 49 may be earthed. In addition a DC bias is applied to the registration roller 49, however, an AC voltage having a DC offset property may be used to uniformly charge the transfer sheet P. The surface of the transfer sheet P passed through the registration roller 49 applied with the bias is negatively charged slightly. Therefore, the transfer condition is occasionally changed when the registration roller is applied with the voltage.

In the embodiment of the image forming apparatus in FIG. 1, a transfer sheet reverser 28 is arranged under the second transferer 22 and the fixer 25 in parallel with the tandem-type image forming device 20. The course of the transfer sheet after an image is fixed thereon is changed by a changing pick toward the transfer sheet reverser. Then, the transfer sheet may be reversed with a toner image transferred thereon, and delivered on the delivery tray.

Next, the above-mentioned tandem-type image forming device will be explained.

Figure 3:
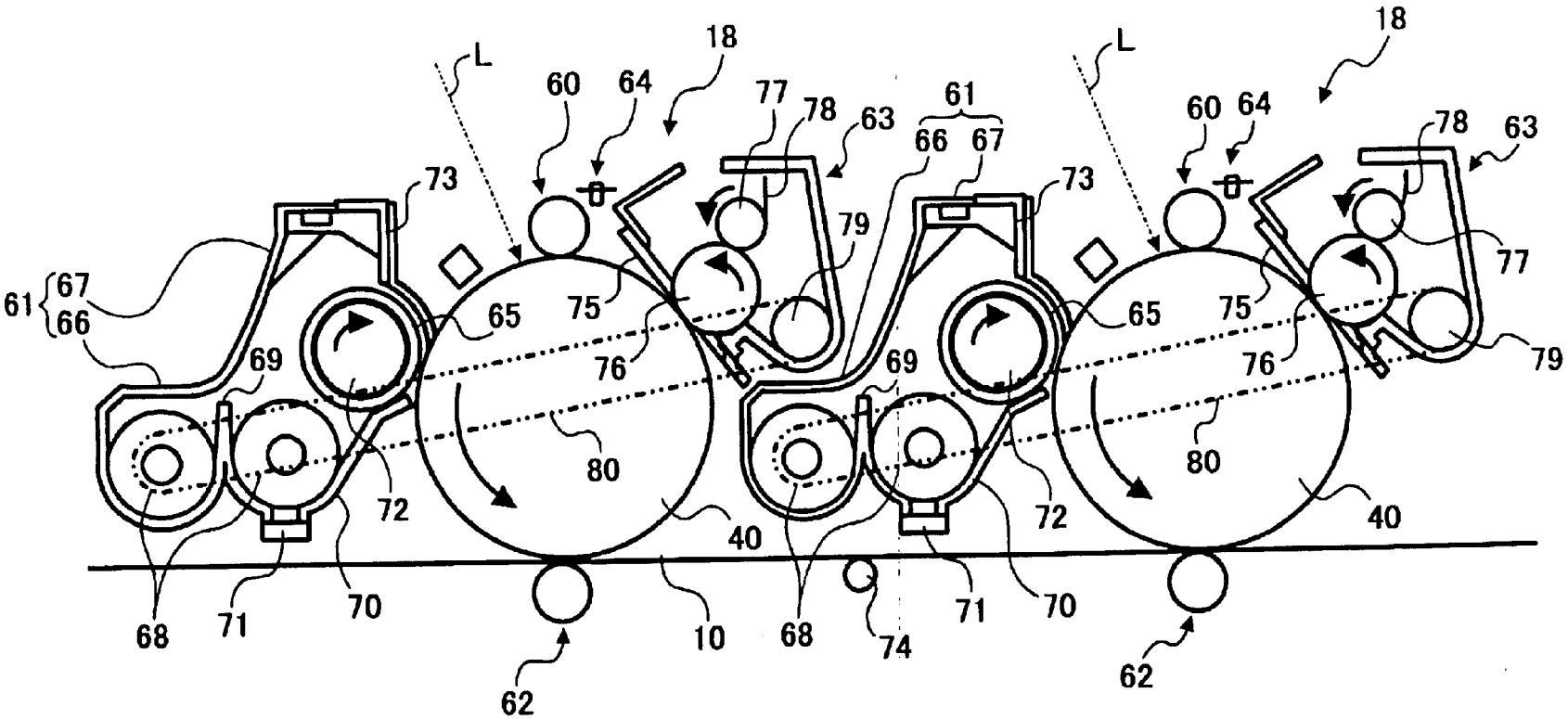
FIG. 3 is a schematic enlarged view illustrating the main part of an embodiment of the tandem-type image forming apparatus of the present invention.

FIG.3 is a schematic enlarged view illustrating the main part of the tandem-type image forming device 20. Since four image forming units 18Bk, 18Y, 18M and 18C have the same structures, the color symbols of Bk, Y, M, and C are omitted and the structure of a unit will be explained. As shown in FIG. 3, a charger 60, the image developer 61, the first transferer as a first transfer means, the photoreceptor cleaners 63 and a discharger 64 are arranged around the photoreceptor drums 40 in the unit.

The above-mentioned photoreceptor drum 40 is drum-shaped and coated with an organic photosensitive material on a tube such as aluminium, however, the photoreceptor may be an endless belt-shaped.

In addition, a process cartridge (not shown) including at least the photoreceptor drum 40 and all or a part of the image forming unit 18 may be formed and detachable with the image forming apparatus 100 for ease of the maintenance.

The charger 60 is roller-shaped and charges the photoreceptor drum 40 while contacting the drum. A non-contact scorotron charger can be also used as the charger.

A one-component developer may be used in the image developer 61, however, in FIG. 3, a two-component developer including a magnetic carrier and a non-magnetic toner is used. The image developer 61 has an agitating portion 66 agitating the two-component developer and adhering the developer to a developing sleeve 65, and a developing portion 67 transferring the toner of the two-component developer to the photoreceptor drum 40. The agitating portion is arranged at a lower position than that of the developing portion.

Figure 4:
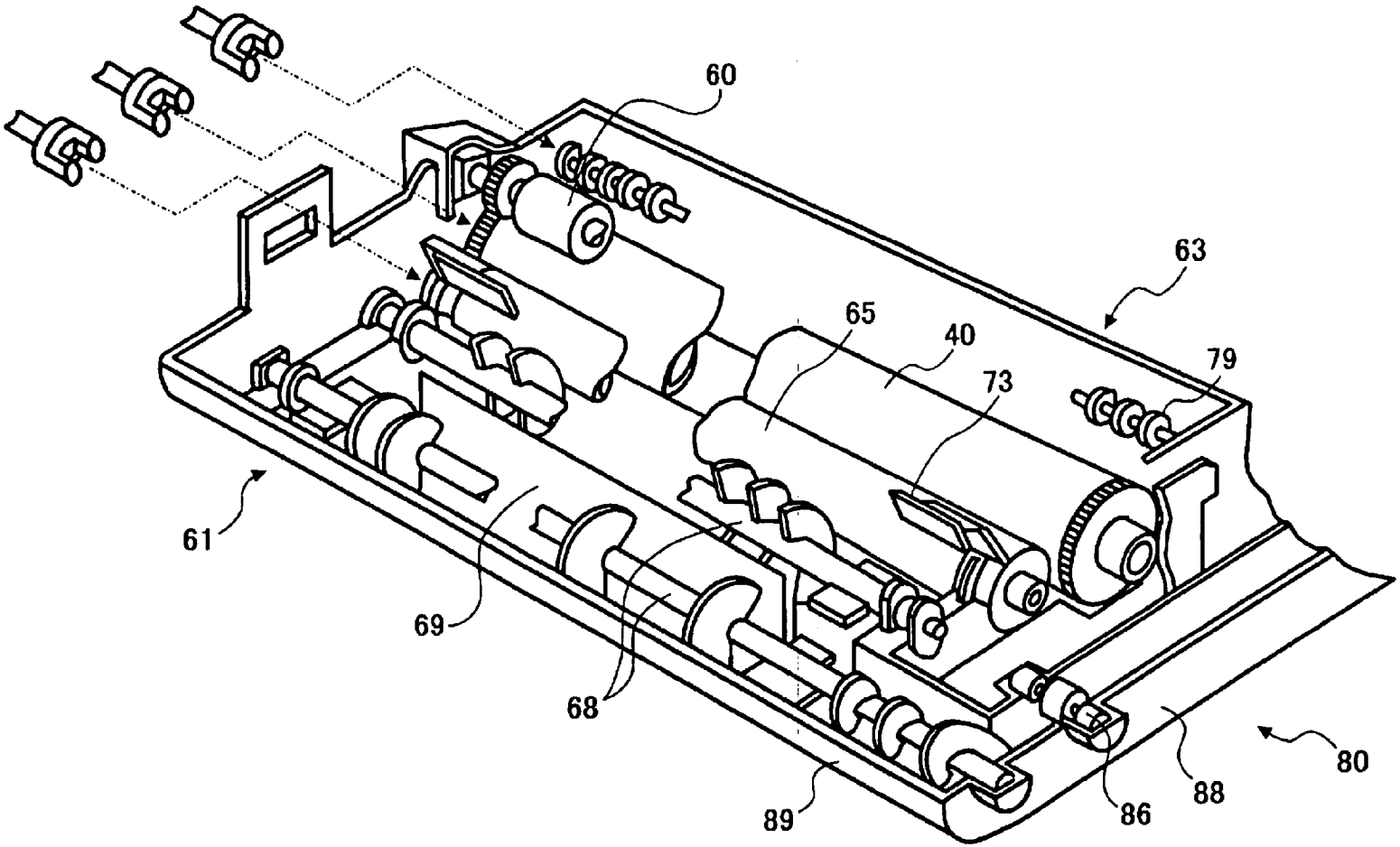
FIG. 4 is an oblique perspective view illustrating an embodiment of the photoreceptor drum and the proximity members of the present invention.

The agitating portion 66 has two parallel screws 68 and a partition plate 69 separates the two screws except for the ends thereof (refer to FIG. 4). In addition, a concentration sensor 71 is formed in a developing case 70.

In the developing portion 67, the developing sleeve 65 is formed to face the photoreceptor drum 40 through the opening of the developing case 70, and a magnet 72 is fixed in the developing sleeve 65. In addition, a doctor blade 73 is formed with the end which is close to the developing sleeve 65. In FIG. 3, the shortest distance between the doctor blade 73 and the developing sleeve 65 is 500 μm.

The developing sleeve 65 is non-magnetic and sleeve-shaped, and has the plural magnets 72 inside. The fixed magnets can apply the magnetic force to the developer when passing the predetermined place. In FIG. 3, the diameter of the developing sleeve is 18 mm, and the surface thereof is abraded with a sand blast or is formed to have plural grooves having a depth of from 1 to a few mm such that the ten-point mean roughness (RZ) is within a range of from 10 to 30 μm.

The magnet 72, for examples, has five poles N1, S1, N2, S2 and S3 in the rotating direction of the developing sleeve from the position of the doctor blade.

The developer forms a magnetic brush by the magnet 72 and is borne on the developing sleeve 65. The developing sleeve 65 is arranged in an area on the S1 side of the magnet 72 which formed the magnetic brush of the developer, facing the photoreceptor drum 40.

Thus, the two-component developer is transferred and circulated by the two screws 68 while being agitated thereby, and supplied to the developing sleeve 65. The developer supplied to the developing sleeve 65 is held by the magnet 72 and forms the magnetic brush on the developing sleeve 65. The head of the magnetic brush is properly cut by the doctor blade 73 in accordance with the rotation of the developing sleeve 65. The cut developer is returned to the agitating portion 66. The toner of the developer borne on the developing sleeve 65 is transferred to the photoreceptor drum 40 by the developing bias voltage applied to the developing sleeve 65, and visualize the latent image on the photoreceptor drum 40. After the visualization, the residual developer on the developing sleeve 65 is released therefrom in a place where the magnetic force of the magnet 72 does not work, and is returned to the agitating portion 66. When the concentration of the toner in the agitating portion 66 becomes lower as the thus process is repeated, the toner concentration sensor 71 detects the low concentration of the toner and the toner is supplied to the agitating portion 66.

In FIG. 3, the linear speeds of the photoreceptor drum 40 and the developing sleeve 65 are 200 mm/sec and 240 mm/sec respectively, and the diameters are 50 mm and 18 mm respectively. The charge quantity of the toner on the developing sleeve 65 is preferably from −10 to −30 $\mu$C/g. The developing gap between the photoreceptor drum 40 and the developing sleeve 65 (GP) can be conventionally adjusted from 0.4 to 0.8 mm. The smaller the gap, the more improved the developing efficiency.

Further, the thickness of the photoreceptor is 30 $\mu$m, the beam spot diameter is 50×60 $\mu$m and the amount of light is 0.47 mW. In addition, the potential of the photoreceptor drum 40 before irradiation V0 is −700 V, the potential after irradiation is −120 V and the developing bias voltage is −470 V, i.e., the developing potential is 350 V to perform the developing process.

The first transferer 62 is a roller-shaped first transfer roller 62 and is pressed against the photoreceptor drum 40 through the intermediate transfer belt 10. Between each first transfer roller, a conductive roller 72 is formed to contact the base layer of the intermediate transfer belt 10. The conductive roller 72 prevents the bias applied by each first transfer roller 62 from flowing into each image forming unit 18 located thereto through the base layer having a middle resistance.

The photoreceptor cleaner 63 has a cleaning blade made of, for example, a polyurethane rubber, and the end of the blade is pressed against the photoreceptor drum 40. Further, in FIG. 3, the conductive fur brush 76 rotatable in the direction indicated by an arrow, whose periphery contacts the photoreceptor drum 40 is arranged. In addition, a metallic electric field roller 77 rotatable in the direction indicated by an arrow, which applies a bias to the fur brush 76 is arranged, and the end of a scraper 67 is pressed against the electric field roller 77. Further, a collection screw 79 collecting the removed toner is also arranged.

In the above-mentioned photoreceptor cleaner 63, the fur brush 76 rotating in the reverse direction of the photoreceptor drum 40 removes the residual toner thereon. The toner adhered to the fur brush 76 is removed by the electric field roller 77 rotating in the reverse direction of the fur brush 76 in contact therewith, and which is applied with a bias. The toner adhered to the electric field roller 77 is removed by the scraper 78. The toner collected in the photoreceptor cleaner 63 is collected together on one side thereof by the collection screw 79 and returned to the image developer 61 by an after-mentioned toner recycler 80 to be recycled.

A discharging lamp is used as the discharger 64 and initializes the surface potential of the photoreceptor drum 40.

The thus developing process will be explained. In accordance with the rotation of the photoreceptor drum 40, the surface thereof is uniformly charged by the charger 60 at first. Imagewise light is irradiated on the photoreceptor drum 40 to form a latent image thereon. The image developer 61 adheres the toner to the latent image to form a toner image, and the toner image is firstly transferred on the intermediate transfer belt 10 by the first transfer roller 62. The residual toner on the surface of the photoreceptor drum 40 after the image transfer is removed by the photoreceptor cleaner 63, and the discharger 64 discharge the photoreceptor drum 40 to stand ready for another image formation. On the other hand, the residual toner removed from the surface of the photoreceptor drum is reused for development by the after-mentioned toner recycler. The order of colors forming an image is not limited thereto, and is different according to the object and property of the image forming apparatus.

Next, the toner recycling process will be explained, referring to FIGS. 4 and 5. FIG. 4 is an oblique perspective view illustrating the photoreceptor drum 40 and the proximity members, and FIG. 5 is an oblique perspective view illustrating the collection screw in the photoreceptor cleaner 63.

Figure 5:
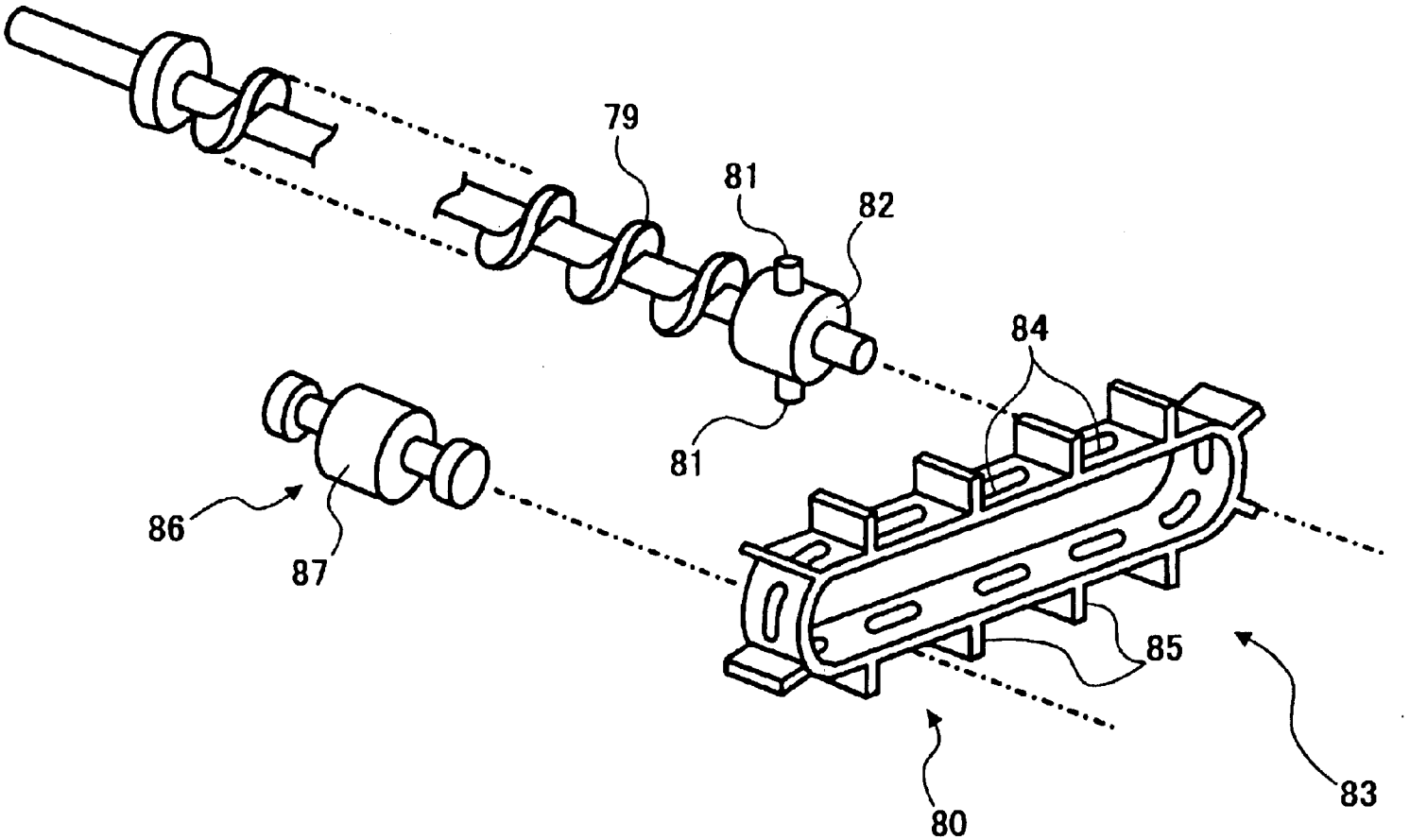
FIG. 5 is an oblique perspective view illustrating an embodiment of the collection screw in the photoreceptor cleaner of the present invention.

As shown in FIG. 5, the collection screw 79 in the photoreceptor cleaner 63 has a roller portion 82 having a pin 81. One side of a collected-toner transfer member 83 which is belt-shaped is hung on the roller portion 82, and the pin 81 is inserted in a long hole 84 of the collected-toner transfer member 83. The periphery of the collected-toner transfer member 83 has blades 85 at a fixed interval, and the other side of the collected-toner transfer member 83 is hung on a roller portion 87 of a rotating axis 86. The collected-toner transfer member 83 is put in a transfer route case 88 shown in FIG. 4 together with the rotating axis 86.

The transfer route case 88 is formed together with a cartridge case 89 in a body, and the end of one of the two screws 68 in the image developer 61 is inserted into the transfer route case 88. An outside driving force rotates the collection screw 79 and the collected-toner transfer member 83, and the toner collected by the photoreceptor cleaner 63 is transferred to the image developer 61 through the transfer route case 88 and put in the image developer 61 by the rotation of the screw 68. Then, as mentioned above, the collected toner is agitated with the developer in the image developer 61 by the two screws 68 and circulated to be used for development.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Examples of Polyester Resins

Polyester Resin Synthesis Example 1

The following materials were mixed in a four-opening separable flask with a stirrer, a thermometer, a nitrogen lead-in opening and a falling condenser with an esterified catalyst:

| | |
|---|---|
| Polyoxypropylene (2,2)-2,2-bis (4-hydroxyphenyl) propane | 740 g |
| Polyoxyethylene (2,2)-2,2-bis (4-hydroxyphenyl) propane | 300 g |
| Dimethylterephthalate | 466 g |
| Isododecenylsuccinic anhydride | 80 g |
| n-butyl 1,2,4-benzenetricarboxylate | 114 g |

The mixture was stirred while heated up to 210° C. at an atmospheric pressure and depressurized at 210° C. Thus, a polyester resin A having the following properties was prepared:

| | |
|---|---|
| The content of a compound having molecular weight not greater than 500 | 3.5% |
| A peak of the molecular weight | 7,500 |
| Glass transition temperature | 62° C. |
| Mw/Mn | 5.1 |
| Acid value | 2.3 KOH mg/g |
| The temperature at which the resin has an apparent viscosity of $10^4$ Pa · s when measured by a flow tester | 112° C. |

Polyester Resin Synthesis Example 2

The procedure for preparing a polyester A was repeated except that the following materials were mixed to prepare a polyester resin B:

| | |
|---|---|
| Polyoxypropylene (2,2)-2,2-bis (4-hydroxyphenyl) propane | 71,225 g |
| Polyoxyethylene (2,2)-2,2-bis (4-hydroxyphenyl) propane | 165 g |
| Dimethylterephthalate | 500 g |
| Isododecenylsuccinic anhydride | 130 g |
| 1,2,4-benzenetricarboxylictriisopropyl | 170 g |
| The polyester resin B had the following properties: | |
| The content of a compound having molecular weight not greater than 500 | 3.0% |
| A peak of the molecular weight | 8,000 |
| Glass transition temperature | 62° C. |
| Mw/Mn | 4.7 |
| Acid value | 0.5 KOH mg/g |
| The temperature at which the resin has an apparent viscosity of $10^4$ Pa · s when measured by a flow tester | 116° C. |

Polyester Resin Synthesis Example 3

The procedure for preparing a polyester A was repeated except that the following materials were mixed to prepare a polyester resin C:

| | |
|---|---|
| Polyoxypropylene (2,2)-2,2-bis (4-hydroxyphenyl) propane | 650 g |
| Polyoxyethylene (2,2)-2,2-bis (4-hydroxyphenyl) propane | 650 g |
| Isophthalic acid | 515 g |
| Isooctenyl succinic acid | 70 g |
| 1,2,4-benzenetricarboxylic acid | 80 g |
| The polyester resin C had the following properties: | |
| The content of a compound having molecular weight not greater than 500 | 2.1% |
| A peak of the molecular weight | 8,200 |
| Glass transition temperature | 61° C. |
| Mw/Mn | 4.6 |

-continued

| | |
|---|---|
| Acid value | 10.0 KOH mg/g |
| The temperature at which the resin has an apparent viscosity of $10^4$ Pa · s when measured by a flow tester | 117° C. |

Polyester Resin Synthesis Example 4

The procedure for preparing a polyester A was repeated except that the following materials were mixed to prepare a polyester resin D:

| | |
|---|---|
| Polyoxypropylene(2,2)-2,2-bis (4-hydroxyphenyl)propane | 714 g |
| Polyoxyethylene(2,2)-2,2-bis (4-hydroxyphenyl)propane | 663 g |
| Isophthalic acid | 648 g |
| Isooctenylsuccinic acid | 150 g |
| 1,2,4-benzenetricarboxylic acid | 120 g |
| The polyester resin D had the following properties: | |
| The content of a compound having molecular weight not greater than 500 | 4.8% |
| A peak of the molecular weight | 9,500 |
| Glass transition temperature | 67° C. |
| Mw/Mn | 8.5 |
| Acid value | 23.2 KOH mg/g |
| The temperature at which the resin has an apparent viscosity of $10^4$ Pa · s when measured by a flow tester | 126° C. |

Synthesis Examples of Resin Charge Controlling Agents

Resin Charge Controlling Agent Synthesis Example 1

600 parts of 3,4-dichlorophenylmaleimide and 100 parts of perfluorooctanesulfonic acid were copolymerized in dimethyl formaldehyde (DMF) at a temperature lower than the boiling point thereof for 8 hrs, using di-t-butylperoxide as an initiator. Next, after 300 parts of n-butyl acrylate was included into the mixture and graft-polymerized for 4 hrs using di-t-butylperoxide as an initiator, the DMF was removed by drying the mixture under reduced pressure to prepare a resin charge controlling agent A having a number average molecular weight of 10,000 and an apparent viscosity of $10^4$ Pa·s at 95° C.

Resin Charge Controlling Agent Synthesis Example 2

600 parts of m-nitrophenylmaleimide and 100 parts of 2-acrylamide-2-methylpropanesulfonic acid were copolymerized in dimethyl formaldehyde (DMF) at a temperature lower than the boiling point thereof for 8 hrs, using di-t-butylperoxide as an initiator. Next, after 250 parts of 2-ethylhexyl acrylate was included into the mixture and graft-polymerized for 4 hrs using di-t-butylperoxide as an initiator, the DMF was removed by drying the mixture under reduced pressure to prepare a resin charge controlling agent B having a number average molecular weight of 1,500 and an apparent viscosity of $10^4$ Pa·s at 85° C.

Resin Charge Controlling Agent Synthesis Example 3

500 parts of 3,4-dichlorophenylmaleimide and 150 parts of 2-acrylamide-2-methylpropanesulfonic acid were copolymerized in dimethyl formaldehyde (DMF) at a temperature lower than the boiling point thereof for 8 hrs, using di-t-butylperoxide as an initiator. Next, after 350 parts of n-butyl acrylate was included into the mixture and graft-polymerized for 4 hrs using di-t-butylperoxide as an initiator, the DMF was removed by drying the mixture under reduced pressure to prepare a resin charge controlling agent C having a number average molecular weight of 98,500 and an apparent viscosity of $10^4$ Pa·s at 110° C.

Resin Charge Controlling Agent Synthesis Example 4

500 parts of 3,4-dichlorophenylmaleimide and 200 parts of perfluorooctanesulfonic acid were copolymerized in dimethyl formaldehyde (DMF) at a temperature lower than the boiling point thereof for 8 hrs, using di-t-butylperoxide as an initiator. Next, after 300 parts of n-butyl acrylate was included into the mixture and graft-polymerized for 4 hrs using di-t-butylperoxide as an initiator, the DMF was removed by drying the mixture under reduced pressure to prepare a resin charge controlling agent D having a number average molecular weight of 12,000 and an apparent viscosity of $10^4$ Pa·s at 102° C.

Resin Charge Controlling Agent Synthesis Example 5

After 400 parts of 3,4-dichlorophenylmaleimide and 100 parts of 2-acrylamide-2-methylpropanesulfonic acid were copolymerized in dimethyl formaldehyde (DMF) at a temperature lower than the boiling point thereof for 8 hrs using di-t-butylperoxide as an initiator, the DMF was removed by drying the mixture under reduced pressure to prepare a resin charge controlling agent E having a number average molecular weight of 5,000 and an apparent viscosity of $10^4$ Pa·s at 101° C.

Resin Charge Controlling Agent Synthesis Example 6

400 parts of 3,4-dichlorophenylmaleimide and 200 parts of perfluorooctanesulfonic acid were copolymerized in dimethyl formaldehyde (DMF) at a temperature lower than the boiling point thereof for 8 hrs, using di-t-butylperoxide as an initiator. Next, after 750 parts of n-butyl acrylate was included into the mixture, the DMF was removed by drying the mixture under reduced pressure to prepare a resin charge controlling agent F having a number average molecular weight of 11,500 and an apparent viscosity of $10^4$ Pa·s at 110° C.

Resin Charge Controlling Agent Synthesis Example 7

450 parts of 3,4-dichlorophenylmaleimide and 150 parts of perfluorooctanesulfonic acid were copolymerized in dimethyl formaldehyde (DMF) at a temperature lower than the boiling point thereof for 3 hrs, using di-t-butylperoxide as an initiator. Next, after 400 parts of methyl acrylate was included into the mixture and graft-polymerized for 4 hrs using di-t-butylperoxide as an initiator, the DMF was removed by drying the mixture under reduced pressure to prepare a resin charge controlling agent G having a number average molecular weight of 950 and an apparent viscosity of $10^4$ Pa·s at 82° C.

Example 1

The following colorants and resins for each color were mixed by a Henshel mixer, and the mixture was kneaded by a two-roll mill having a temperature of 100° C. for 30 min. Then, the kneaded mixture was cooled and crushed by a hammer mill to prepare a colorant treated with the resin A.

| | |
|---|---|
| Yellow colorant: | |
| Polyester resin A | 200 |
| C.I. pigment yellow 180 | 100 |
| Red colorant: | |
| Polyester resin A | 200 |
| C.I. pigment red 122 | 100 |
| Blue colorant: | |
| Polyester resin A | 200 |
| C.I. pigment blue 15 | 100 |

-continued

| | |
|---|---|
| Black colorant: | |
| Polyester resin A | 200 |
| Carbon black | 100 |

Next, the following materials for each color were mixed by a Henshel mixer, and the mixture was kneaded by a roll mill having a temperature of 110° C. for 30 min. The kneaded mixture was cooled and crushed by a hammer mill, and pulverized by an air jet mill pulverizer. Fine powders were further removed from the pulverized mixture by a wind-force classifier to prepare each color toner.

| | |
|---|---|
| Yellow toner: | |
| Polyester resin A | 88 |
| Yellow colorant treated with the resin A | 18 |
| Resin charge controlling agent A | 3 |
| Magenta toner: | |
| Polyester resin A | 90 |
| Red colorant treated with the resin A | 15 |
| Resin charge controlling agent A | 3 |
| Cyan toner: | |
| Polyester resin A | 94 |
| Blue colorant treated with the resin A | 9 |
| Resin charge controlling agent A | 3 |
| Black toner: | |
| Polyester resin A | 86 |
| Black colorant treated with the resin A | 18 |
| Blue colorant treated with the resin A | 3 |
| Resin charge controlling agent A | 3 |

$T_1$(a temperature at which the polyester resin had an apparent viscosity of $10^4$ Pa·S when measured by a flow tester)/$T_2$ (a temperature at which the resin charge controlling agent had an apparent viscosity of $10^4$ Pa·S when measured by a flow tester) was 1.18. 0.8 parts of a hydrophobic silica and 0.6 parts of a hydrophobic titanium oxide were mixed with 100 parts of each color toner by a Henshel mixer to prepare a one-component developer.

The one-component developer was set in a commercially manufactured digital full-color printer IPSio Color 4100N from Ricoh Company, Ltd. to produce an image. The image was clear and no defect such as background fouling was observed. The charge quantity on the developing roller was measured by a suction method and the results were as follows:

| | |
|---|---|
| Yellow developer: | −38 μC/g |
| Magenta developer: | −35 μC/g |
| Cyan developer: | −36 μC/g |
| Black developer: | −34 μC/g |

An image was produced and the charge quantity was measured under an environment of high temperature and humidity (30° C. and 90% RH) and of low temperature and humidity (10° C. and 15% RH) as well. No significant change was observed and a good image was produced in the both environments. In addition, a full-color image was produced on an OHP sheet at a normal temperature. The full-color image projected by an overhead projector was clear.

Further, even after 50,000 full-color images were produced at a normal temperature, no change was observed in the fixed images and the 50,000$^{th}$ image was clear without background fouling. The charge quantity of the developer was also stable as follows:

| | |
|---|---|
| Yellow developer: | −37 μC/g |
| Magenta developer: | −33 μC/g |
| Cyan developer: | −36 μC/g |
| Black developer: | −32 μC/g |

After 50,000 images were produced, the developing roller, blade and photoreceptor were visually observed to find no toner filming. In addition, 10 g of each color toner was put in a heat-resistant glass case having a capacity of 30 cc, and the case was left in a constant temperature bath having a temperature of 50° C. for 5 days. No defect such as agglomeration of the toner was observed and good fluidity thereof was maintained.

Example 2

The following colorants and resins for each color were mixed by a Henshel mixer, and the mixture was kneaded by an air-cooled two-roll mill for 15 min. Then, the kneaded mixture was cooled and crushed by a hammer mill to prepare a colorant treated with the resin B.

| | |
|---|---|
| Yellow colorant: | |
| Polyester resin B | 100 |
| C.I. pigment yellow 180 | 100 |
| Red colorant: | |
| Polyester resin B | 100 |
| C.I. pigment red 57:1 | 100 |
| Blue colorant: | |
| Polyester resin B | 100 |
| C.I. pigment blue 15 | 100 |

Next, the following materials for each color were mixed by a Henshel mixer, and the mixture was kneaded by a biaxial continuous kneader having a temperature of 80° C. The kneaded mixture was cooled and crushed by a hammer mill, and pulverized by an airflow pulverizer. Fine powders were further removed from the pulverized mixture by a wind-force classifier to prepare each color toner.

| | |
|---|---|
| Yellow toner: | |
| Polyester resin B | 94 |
| Yellow colorant treated with the resin B | 12 |
| Resin charge controlling agent B | 2 |
| Magenta toner: | |
| Polyester resin B | 95 |
| Red colorant treated with the resin B | 10 |
| Resin charge controlling agent B | 4 |

-continued

| | |
|---|---|
| Cyan toner: | |
| Polyester resin B | 96 |
| Blue colorant treated with the resin B | 8 |
| Resin charge controlling agent B | 3 |
| Black toner: | |
| Polyester resin B | 99 |
| Blue colorant treated with the resin B | 2 |
| Carbon black | 6 |
| Resin charge controlling agent B | 3 |

$T_1/T_2$ was 1.36. 1.0 parts of a hydrophobic silica and 0.6 parts of a hydrophobic titanium oxide were mixed with 100 parts of each color toner by a Henshel mixer to prepare a one-component developer.

The one-component developer was, as it was in Example 1, set in a commercially manufactured digital full-color printer IPSio Color 4100N from Ricoh Company, Ltd. to produce an image. The image was clear and no defect such as background fouling was observed. The charge quantity on the developing roller was measured by a suction method and the results were as follows:

| | |
|---|---|
| Yellow developer: | −40 μC/g |
| Magenta developer: | −38 μC/g |
| Cyan developer: | −39 μC/g |
| Black developer: | −38 μC/g |

A projected image through an OHP sheet on which a full-color image was produced was also clear. No defective image was observed even when the image was produced under an environment of high temperature and humidity and of low temperature and humidity. Further, even after 50,000 images were produced, no significant change was observed in both the images and the charge quantity. After 50,000 images were produced, the developing roller, blade and photoreceptor were visually observed to find no toner filming. In addition, each color toner was left in a constant temperature bath having a temperature of 50° C. for 5 days. No defect such as agglomeration of the toner was observed and good fluidity thereof was maintained.

Example 3

The following colorants and resins for each color were mixed by a Henshel mixer, and the mixture was kneaded by a two-roll mill having a temperature of 110° C. for 30 min. Then, the kneaded mixture was cooled and crushed by a hammer mill to prepare a colorant treated with the resin C.

| | |
|---|---|
| Yellow colorant: | |
| Polyester resin C | 200 |
| C.I. pigment yellow 180 | 100 |
| Red colorant: | |
| Polyester resin C | 200 |
| C.I. pigment red 146 | 100 |

-continued

| | |
|---|---|
| Blue colorant: | |
| Polyester resin C | 200 |
| C.I. pigment blue 15 | 100 |
| Black colorant: | |
| Polyester resin C | 200 |
| Carbon black | 100 |

Next, the following materials for each color were mixed by a Henshel mixer, and the mixture was kneaded by a biaxial continuous kneader having a temperature of 80° C. The kneaded mixture was cooled and crushed by a hammer mill, and pulverized by a mechanical pulverizer. Fine powders were further removed from the pulverized mixture by a wind-force classifier to prepare each color toner.

| | |
|---|---|
| Yellow toner: | |
| Polyester resin C | 88 |
| Yellow colorant treated with the resin C | 18 |
| Resin charge controlling agent C | 1 |
| Magenta toner: | |
| Polyester resin C | 90 |
| Red colorant treated with the resin C | 15 |
| Resin charge controlling agent C | 2 |
| Cyan toner: | |
| Polyester resin C | 94 |
| Blue colorant treated with the resin C | 9 |
| Resin charge controlling agent C | 2 |
| Black toner: | |
| Polyester resin C | 96 |
| Black colorant treated with the resin C | 18 |
| Blue colorant treated with the resin C | 3 |
| Resin charge controlling agent C | 2 |

$T_1/T_2$ was 1.06. 0.8 parts of a hydrophobic silica and 0.4 parts of a hydrophobic titanium oxide were mixed with 100 parts of each color toner by a Henshel mixer. Then, 8 parts of the each mixed color toner and 92 parts of magnetite carrier coated with a silicone resin were mixed to prepare a two-component developer. The charge quantity of the developer was measured by a blowoff method and the results were as follows:

| | |
|---|---|
| Yellow developer: | −18 μC/g |
| Magenta developer: | −15 μC/g |
| Cyan developer: | −17 μC/g |
| Black developer: | −16 μC/g |

The two-component developer was set in a commercially manufactured digital full-color copier Imagio Color 4055 from Ricoh Company, Ltd. to produce an image. The image was clear and no defect such as background fouling was observed. A projected image through an OHP sheet on which a full-color image was produced was also clear. No defective image was observed even when the image was produced under an environment of high temperature and humidity and of low temperature and humidity. Further, even after 50,000 images were produced, no significant change was observed in both the images and the charge quantity. After 50,000 images were produced, the developing roller, blade and photoreceptor were visually observed to find no toner filming. In addition, each color toner was left in a constant temperature bath having a temperature of 50° C. for 5 days. No defect such as agglomeration of the toner was observed and good fluidity thereof was maintained.

Comparative Example 1

The following colorants and resins for each color were mixed by a Henshel mixer, and the mixture was kneaded by a two-roll mill having a temperature of 100° C. for 30 min. Then, the kneaded mixture was cooled and crushed by a hammer mill to prepare a colorant treated with the resin D.

| | |
|---|---|
| Yellow colorant: | |
| Polyester resin D | 200 |
| C.I. pigment yellow 180 | 100 |
| Red colorant: | |
| Polyester resin D | 200 |
| C.I. pigment red 122 | 100 |
| Blue colorant: | |
| Polyester resin D | 200 |
| C.I. pigment blue 15 | 100 |
| Black colorant: | |
| Polyester resin D | 200 |
| Carbon black | 100 |

Next, the following materials for each color were mixed by a Henshel mixer, and the mixture was kneaded by a roll mill having a temperature of 110° C. for 30 min. The kneaded mixture was cooled and crushed by a hammer mill, and pulverized by an air jet mill pulverizer. Fine powders were further removed from the pulverized mixture by a wind-force classifier to prepare each color toner.

| | |
|---|---|
| Yellow toner: | |
| Polyester resin D | 88 |
| Yellow colorant treated with the resin D | 18 |
| Resin charge controlling agent B | 3 |
| Magenta toner: | |
| Polyester resin D | 90 |
| Red colorant treated with the resin D | 15 |
| Resin charge controlling agent B | 3 |
| Cyan toner: | |
| Polyester resin D | 94 |
| Blue colorant treated with the resin D | 9 |
| Resin charge controlling agent B | 3 |
| Black toner: | |
| Polyester resin D | 86 |
| Black colorant treated with the resin D | 18 |
| Blue colorant treated with the resin D | 3 |
| Resin charge controlling agent B | 3 |

$T_1/T_2$ was 1.48. 0.8 parts of a hydrophobic silica and 0.6 parts of a hydrophobic titanium oxide were mixed with 100 parts of each color toner by a Henshel mixer to prepare a one-component developer.

The one-component developer was set in a commercially manufactured digital full-color printer IPSio Color 4100N from Ricoh Company, Ltd. to produce an image. The image was a defective image with noticeable background fouling. The charge quantity on the developing roller was measured by a suction method and the results were rather low on the whole as follows:

| | |
|---|---|
| Yellow developer: | −25 μC/g |
| Magenta developer: | −19 μC/g |
| Cyan developer: | −23 μC/g |
| Black developer: | −21 μC/g |

When an image was produced under an environment of high temperature and humidity (30° C. and 90% RH), the background fouling became worse. A full-color image produced on an OHP sheet had poor transparency. After 30,000 images were produced, the background fouling became worse and the developing roller, blade and photoreceptor were visually observed to find toner filming on all of them. However, each color toner was left in a constant temperature bath having a temperature of 50° C. for 5 days to find that there was no defect such as agglomeration of the toner and good fluidity thereof was maintained.

Comparative Example 2

The following colorants and resins for each color were mixed by a Henshel mixer, and the mixture was kneaded by a two-roll mill having a temperature of 100° C. for 30 min. Then, the kneaded mixture was cooled and crushed by a hammer mill to prepare a colorant treated with the resin D.

| | |
|---|---|
| Yellow colorant: | |
| Polyester resin D | 200 |
| C.I. pigment yellow 180 | 100 |
| Red colorant: | |
| Polyester resin D | 200 |
| C.I. pigment red 122 | 100 |
| Blue colorant: | |
| Polyester resin D | 200 |
| C.I. pigment blue 15 | 100 |

Next, the following materials for each color were mixed by a Henshel mixer, and the mixture was kneaded by a biaxial kneader having a temperature of 80° C. The kneaded mixture was cooled and crushed by a hammer mill, and pulverized by an airflow pulverizer. Fine powders were further removed from the pulverized mixture by a wind-force classifier to prepare each color toner.

| | |
|---|---|
| Yellow toner: | |
| Polyester resin D | 88 |
| Yellow colorant treated with the resin D | 18 |
| Resin charge controlling agent D | 2 |
| Magenta toner: | |
| Polyester resin D | 90 |
| Red colorant treated with the resin D | 15 |
| Resin charge controlling agent D | 3 |

-continued

| | |
|---|---|
| Cyan toner: | |
| Polyester resin D | 96 |
| Blue colorant treated with the resin D | 8 |
| Resin charge controlling agent D | 3 |
| Black toner: | |
| Polyester resin D | 98 |
| Blue colorant treated with the resin D | 3 |
| Carbon black | 6 |
| Resin charge controlling agent D | 3 |

$T_1/T_2$ was 1.24. 0.8 parts of a hydrophobic silica and 0.6 parts of a hydrophobic titanium oxide were mixed with 100 parts of each color toner by a Henshel mixer to prepare a one-component developer.

The one-component developer was set in a commercially manufactured digital full-color printer IPSio Color 4100N from Ricoh Company, Ltd. to produce an image to find the image clear. A projected image through an OHP sheet on which a full-color image was produced was also clear. When an image was produced under an environment of high temperature and humidity and of low temperature and humidity, no defective image was observed. After 30,000 images were produced, the background fouling began to be noticeable and the $50{,}000^{th}$ image was a defective image. The developing roller, blade and photoreceptor were visually observed to find toner filming on all of them. However, each color toner was left in a constant temperature bath having a temperature of 50° C. for 5 days to find that there was no defect such as agglomeration of the toner and good fluidity thereof was maintained.

Comparative Example 3

The following colorants and resins for each color were mixed by a Henshel mixer, and the mixture was kneaded by an air-cooled two-roll mill for 15 min. Then, the kneaded mixture was cooled and crushed by a hammer mill to prepare a colorant treated with the resin A.

| | |
|---|---|
| Yellow colorant: | |
| Polyester resin A | 100 |
| C.I. pigment yellow 180 | 100 |
| Red colorant: | |
| Polyester resin A | 100 |
| C.I. pigment red 57:1 | 100 |
| Blue colorant: | |
| Polyester resin A | 100 |
| C.I. pigment blue 15 | 100 |

Next, the following materials for each color were mixed by a Henshel mixer, and the mixture was kneaded by a biaxial kneader having a temperature of 110° C. for 30 min. The kneaded mixture was cooled and crushed by a hammer mill, and pulverized by an airflow pulverizer. Fine powders were further removed from the pulverized mixture by a wind-force classifier to prepare each color toner.

| | |
|---|---|
| Yellow toner: | |
| Polyester resin A | 94 |
| Yellow colorant treated with the resin A | 12 |
| Resin charge controlling agent G | 2 |
| Magenta toner: | |
| Polyester resin A | 95 |
| Red colorant treated with the resin D | 10 |
| Resin charge controlling agent G | 4 |
| Cyan toner: | |
| Polyester resin A | 96 |
| Blue colorant treated with the resin A | 8 |
| Resin charge controlling agent G | 3 |
| Black toner: | |
| Polyester resin A | 99 |
| Blue colorant treated with the resin A | 2 |
| Carbon black | 6 |
| Resin charge controlling agent G | 3 |

$T_1/T_2$ was 1.37. 1.0 parts of a hydrophobic silica and 0.6 parts of a hydrophobic titanium oxide were mixed with 100 parts of each color toner by a Henshel mixer to prepare a one-component developer.

The one-component developer was, as it was in Example 1, set in a commercially manufactured digital full-color printer IPSio Color 4100N from Ricoh Company, Ltd. to produce an image. The image was clear without background fouling. A projected image through an OHP sheet on which a full-color image was produced was also clear. When an image was produced under an environment of high temperature and humidity of low temperature and humidity, no defective image was observed. After 20,000 images were produced, the background fouling began to be noticeable and the 50,000$^{th}$ image was a defective image. After 50,000 images were produced, the developing roller, blade and photoreceptor were visually observed to find toner filming on all of them. In addition, each color toner was left in a constant temperature bath having a temperature of 50° C. for 5 days to find that the toner was solidified.

This document claims priority and contains subject matter related to Japanese Patent Applications Nos. 2001-104861, 2001-188490 and 2001-208441, filed on Apr. 3, 2001, Jun. 21, 2001, and Jul. 9, 2001 respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin;

a colorant; and a charge controlling agent;

wherein the binder resin comprises a polyester resin having a weight average molecular weight distribution such that components having a weight average molecular weight not greater than 500 are included in an amount of not greater than 4% by weight and at least a peak is present in a range of from 3,000 to 9,000 when measured by Gel Permeation Chromatography, wherein the binder resin does not include a tetrahydrofuran-insoluble compound, and wherein said polyester is nonlinear; and wherein the charge controlling agent comprises a resin charge controlling agent comprising units obtained from;

a monomer having a sulfonate group;

an aromatic monomer having an electron absorption group; and at least one member selected from the group consisting of an acrylic ester monomer and a methacrylic ester monomer.

2. The toner of claim 1, wherein the binder resin has an endothermic peak in a temperature range of from 60 to 70° C. when measured by a differential scanning calorimeter.

3. The toner of claim 1, wherein the binder resin has a ratio (Mw/Mn) of from 2 to 10, wherein Mw represents a weight average molecular weight and Mn represents a number average molecular weight.

4. The toner of claim 1, wherein the binder resin has an acid value not greater than 20 KOH mg/g.

5. The toner of claim 1, wherein the binder resin has an apparent viscosity of $10^4$Pa·S when measured by a flow tester at a temperature of from 95 to 120° C.

6. The toner of claim 1, wherein the unit obtained from the monomer having a sulfonate group is present in an amount of from 1 to 30% by weight; the unit obtained from the aromatic monomer having an electron absorption group is present in an amount of from 1 to 80% by weight; and the unit obtained from one member selected from the group consisting of an acrylic ester monomer and a methacrylic ester monomer is present in an amount of from 10 to 80% by weight, based on total weight of the resin charge controlling agent.

7. The toner of claim 1, wherein the aromatic monomer having an electron absorption group is at least one member selected from the group consisting of a phenylmaleimide substituted by at least one member selected from the group consisting of a chlorine atom and a nitro group; and a phenylitaconimide substituted by at least one member selected from the group consisting of a chlorine atom and a nitro group.

8. The toner of claim 1, wherein the resin charge controlling agent has an apparent viscosity of $10^4$Pa·S when measured by a flow tester at a temperature of from 85 to 110° C.

9. The toner of claim 1, wherein the resin charge controlling agent has a number average molecular weight of from 1,000 to 10,000.

10. The toner of claim 1, wherein the binder resin and the resin charge controlling agent satisfy the following relationship:

$$0.9<T_1/T_2<1.4;$$

wherein $T_1$ represents a temperature at which the binder resin has an apparent viscosity of $10^4$ Pa·S when measured by a flow tester; and $T_2$ represents a temperature at which the resin charge controlling agent has an apparent viscosity of $10^4$ Pa·S when measured by a flow tester.

11. The toner of claim 1, wherein the resin charge controlling agent is present in an amount of from 0.1 to 20 by weight based on total weight of the toner.

12. The toner of claim 1, wherein the colorant comprises a compound classified in C.I. Pigment Yellow 180.

13. The toner of claim 1, wherein the colorant comprises a compound having the following formula (1):

(1)

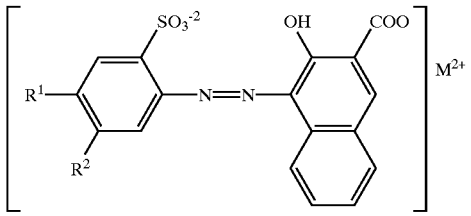

wherein $R^1$ and $R^2$ are each, independently, selected from the group consisting of a hydrogen atom, an alkyl group, a phenyl group and a halogen atom; and M is Ba, Ca, Sr, Mn or Mg.

14. A two-component developer comprising:

a toner; and a carrier, wherein the toner is the toner according to claim 1.

15. A one-component developer comprising a toner, wherein the toner is the toner according to claim 1.

16. A cartridge comprising a container containing therein the two-component developer according to claim 14.

17. A cartridge comprising a container containing therein the one-component developer according to claim 15.

18. An image forming method comprising:

forming an electrostatic latent image on a latent image bearer;

developing the electrostatic latent image with a developer comprising a toner to form a toner image on the latent image bearer;

transferring the toner image onto a receiving material; and fixing the toner image on the receiving material upon application of heat, wherein the toner is the toner according to claim 1.

19. The image forming method of claim 18, wherein the developing step comprises:

forming a thin layer of the developer on a developer bearer; and developing the electrostatic latent image with the thin layer of the developer.

20. The image forming method of claim 18, wherein the binder resin has an endothermic peak in a temperature range of from 60 to 70° C. when measured by a differential scanning calorimeter.

21. The image forming method of claim 18, wherein the binder resin has a ratio (Mw/Mn) of from 2 to 10, wherein Mw represents a weight average molecular weight and Mn represents a number average molecular weight.

22. The image forming method of claim 18, wherein the binder resin has an acid value not greater than 20 KOH mg/g.

23. The image forming method of claim 18, wherein the binder resin has an apparent viscosity of $10^4$Pa·S when measured by a flow tester at a temperature of from 95 to 120° C.

24. The image forming method of claim 18, wherein the unit obtained from the monomer having a sulfonate group is present in an amount of from 1 to 30% by weight; the unit obtained from the aromatic monomer having an electron absorption group is present in an amount of from 1 to 80 by weight; and the unit obtained from one member selected from the group consisting of an acrylic ester monomer and a methacrylic ester monomer is present in an amount of from 10 to 80% by weight, based on total weight of the resin charge controlling agent.

25. The image forming method of claim 18, wherein the aromatic monomer having an electron absorption group is at least one member selected from the group consisting of a phenylmaleimide substituted by at least one member selected from the group consisting of a chlorine atom and a nitro group; and a phenylitaconimide substituted by at least one member selected from the group consisting of a chlorine atom and a nitro group.

26. The image forming method of claim 18, wherein the resin charge controlling agent has an apparent viscosity of $10^4$Pa·S when measured by a flow tester at a temperature of from 85 to 110° C.

27. The image forming method of claim 18, wherein the resin charge controlling agent has a number average molecular weight of from 1,000 to 10,000.

28. The image forming method of claim 18, wherein the binder resin and the resin charge controlling agent satisfy the following relationship:

$$0.9<T_1/T_2<1.4;$$

wherein $T_1$ represents a temperature at which the binder resin has an apparent viscosity of $10^4$ Pa·S when measured by a flow tester; and $T_2$ represents a temperature at which the resin charge controlling agent has an apparent viscosity of $10^4$ Pa·S when measured by a flow tester.

29. The image forming method of claim 18, wherein the resin charge controlling agent is present in an amount of from 0.1 to 20% by weight based on total weight of the toner.

30. The image forming method of claim 18, wherein the colorant comprises a compound classified in C.I. Pigment Yellow 180.

31. The image forming method of claim 18, wherein the colorant comprises a compound having the following formula (1)

(1)

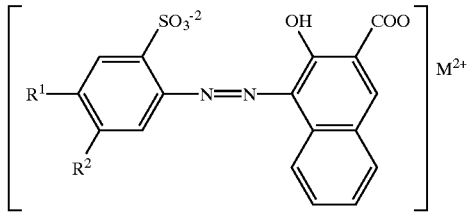

wherein $R^1$ and $R^2$ are each, independently, selected from the group consisting of a hydrogen atom, an alkyl group, a phenyl group and a halogen atom; and M is Ba, Ca, Sr, Mn or Mg.

32. A color image forming method comprising:

developing electrostatic latent images formed on plural image bearers with plural color developers each comprising a different color toner to form a different color toner image on each of the latent image bearers; and transferring the color toner images onto a receiving material one by one with a transferer while pressing the receiving material against each of the latent image bearers, wherein each of the different color toners is the toner according to claim 1.

33. The color image forming method of claim 32, wherein the binder resin has an endothermic peak in a temperature range of from 60 to 70° C. when measured by a differential scanning calorimeter.

34. The color image forming method of claim 32, wherein the binder resin has a ratio (Mw/Mn) of from 2 to 10, wherein Mw represents a weight average molecular weight and Mn represents a number average molecular weight.

35. The color image forming method of claim 32, wherein the binder resin has an acid value not greater than 20 KOH mg/g.

36. The color image forming method of claim 32, wherein the binder resin has an apparent viscosity of $10^4$Pa·S when measured by a flow tester at a temperature of from 95 to 120° C.

37. The color image forming method of claim 32, wherein the unit obtained from the monomer having a sulfonate group is present in an amount of from 1 to 30 by weight; the unit obtained from the aromatic monomer having an electron absorption group is present in an amount of from 1 to 80% by weight; and the unit obtained from one member selected from the group consisting of an acrylic ester monomer and a methacrylic ester monomer is present in an amount of from 10 to 80% by weight, based on total weight of the resin charge controlling agent.

38. The color image forming method of claim 32, wherein the aromatic monomer having an electron absorption group is at least one member selected from the group consisting of phenylmaleimide substituted by at least one member selected from the group consisting of a chlorine atom and a nitro group; and a phenylitaconimide substituted by at least one member selected from the group consisting of a chlorine atom and a intro group.

39. The color image forming method of claim 32, wherein the resin charge controlling agent has an apparent viscosity of $10^4$Pa·S when measured by a flow tester at a temperature of from 85 to 110° C.

40. The color image forming method of claim 32, wherein the resin charge controlling agent has a number average molecular weight of from 1,000 to 10,000.

41. The color image forming method of claim 32, wherein the binder resin and the resin charge controlling agent satisfy the following relationship:

$$0.9<T_1/T_2<1.4;$$

wherein $T_1$ represents a temperature at which the binder resin has an apparent viscosity of $10^4$ Pa·S when measured by a flow tester; and $T_2$ represents a temperature at which the resin charge controlling agent has an apparent viscosity of $10^4$ Pa·S when measured by a flow tester.

42. The color image forming method of claim 32, wherein the resin charge controlling agent is present in an amount of from 0.1 to 20% by weight based on total weight of the toner.

43. The color image forming method of claim 32, wherein the colorant comprises a compound classified in C.I. Pigment Yellow 180.

44. The color image forming method of claim 32, wherein the colorant comprises a compound having the following formula (1)

(1)

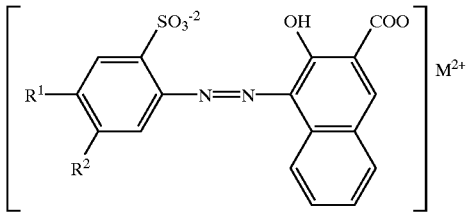

wherein $R^1$ and $R^2$ are each, independently, selected from the group consisting of a hydrogen atom, an alkyl group, a phenyl group and a halogen atom; and M is Ba, Ca, Sr, Mn or Mg.

45. An image forming apparatus comprising:

an irradiator configured to irradiate a latent image bearer to form an electrostatic latent image thereon;

an image developer configured to develop the electrostatic latent image with a developer to form a toner image;

a transferer configured to transfer the toner image onto a receiving material; a fixer configured to fix the toner image on the receiving material upon application of heat; and a cartridge configured to contain the developer, wherein the cartridge is the cartridge according to claim 16.

46. The image forming apparatus of claim 45, wherein the binder resin has an endothermic peak in a temperature range of from 60 to 70° C when measured by a differential scanning calorimeter.

47. The image forming apparatus of claim 45, wherein the binder resin has a ratio (Mw/Mn) of from 2 to 10, wherein Mw represents a weight average molecular weight and Mn represents a number average molecular weight.

48. The image forming apparatus of claim 45, wherein the binder resin has an acid value not greater than 20 KOH mg/g.

49. The image forming apparatus of claim 45, wherein the binder resin has an apparent viscosity of $10^4$Pa·S when measured by a flow tester at a temperature of from 95 to 120° C.

50. The image forming apparatus of claim 45, wherein the unit obtained from the monomer having a sulfonate group is present in an amount of from 1 to 30% by weight; the unit obtained from the aromatic monomer having an electron absorption group is present in an amount of from 1 to 80% by weight; and the unit obtained from one member selected from the group consisting of an acrylic ester monomer and a methacrylic ester monomer is present in an amount of from 10 to 80% by weight, based on total weight of the resin charge controlling agent.

51. The image forming apparatus of claim 45, wherein the aromatic monomer having an electron absorption group is at least one member selected from the group consisting of a phenylmaleimide substituted by at least one member selected from the group consisting of a chlorine atom and a intro group; and a phenylitaconimide substituted by at least one member selected from the group consisting of a chlorine atom and a nitro group.

52. The image forming apparatus of claim 45, wherein the resin charge controlling agent has an apparent viscosity of $10^4$Pa·S when measured by a flow tester at a temperature of from 85 to 110° C.

53. The image forming apparatus of claim 45, wherein the resin charge controlling agent has a number average molecular weight of from 1,000 to 10,000.

54. The image forming apparatus of claim 45, wherein the binder resin and the resin charge controlling agent satisfy the following relationship $$0.9<T_1/T_2<1.4;$$

wherein $T_1$ represents a temperature at which the binder resin has an apparent viscosity of $10^4$ Pa·S when measured by a flow tester; and $T_2$ represents a temperature at which the resin charge controlling agent has an apparent viscosity of $10^4$ Pa·S when measured by a flow tester.

55. The image forming apparatus of claim 45, wherein the resin charge controlling agent is present in an amount of from 0.1 to 20% by weight based on total weight of the toner.

56. The image forming apparatus of claim 45, wherein the colorant comprises a compound classified in C.I. Pigment Yellow 180.

57. The image forming apparatus of claim 45, wherein the colorant comprises a compound having the following formula (1):

(1)

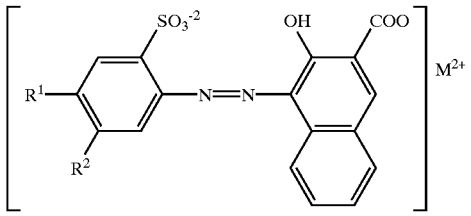

wherein $R^1$ and $R^2$ are each, independently, selected from the group consisting of a hydrogen atom, an alkyl group, a phenyl group and a halogen atom; and M is Ba, Ca, Sr, Mn or Mg.

58. An image forming apparatus comprising:

an irradiator configured to irradiate a latent image bearer to form an electrostatic latent image thereon;

an image developer configured to develop the electrostatic latent image with a developer to form a toner image;

a transferer configured to transfer the toner image onto a receiving material;

a fixer configured to fix the toner image on the receiving material upon application of heat; and a cartridge configured to contain the developer, wherein the cartridge is the cartridge according to claim 17.

59. The image forming apparatus of claim 58, wherein the binder resin has an endothermic peak in a temperature range of from 60 to 70° C. when measured by a differential scanning calorimeter.

60. The image forming apparatus of claim 58, wherein the binder resin has a ratio (Mw/Mn) of from 2 to 10, wherein Mw represents a weight average molecular weight and Mn represents a number average molecular weight.

61. The image forming apparatus of claim 58, wherein the binder resin has an acid value not greater than 20 KOH mg/g.

62. The image forming apparatus of claim 58, wherein the binder resin has an apparent viscosity of $10^4$Pa·S when measured by a flow tester at a temperature of from 95 to 120° C.

63. The image forming apparatus of claim 58, wherein the unit obtained from the monomer having a sulfonate group is present in an amount of from 1 to 30% by weight; the unit obtained from the aromatic monomer having an electron absorption group is present in an amount of from 1 to 80% by weight; and the unit obtained from one member selected from the group consisting of an acrylic ester monomer and a methacrylic ester monomer is present in an amount of from 10 to 80% by weight, based on total weight of the resin charge controlling agent.

64. The image forming apparatus of claim 58, wherein the aromatic monomer having an electron absorption group is at least one member selected from the group consisting of a phenylmaleimide substituted by at least one member selected from the group consisting of a chlorine atom and a nitro group; and a phenylitaconimide substituted by at least one member selected from the group consisting of a chlorine atom and a nitro group.

65. The image forming apparatus of claim 58, wherein the resin charge controlling agent has an apparent viscosity of $10^4$Pa·S when measured by a flow tester at a temperature of from 85 to 110° C.

66. The image forming apparatus of claim 58, wherein the resin charge controlling agent has a number average molecular weight of from 1,000 to 10,000.

67. The image forming apparatus of claim 58, wherein the binder resin and the resin charge controlling agent satisfy the following relationship:

$$0.9<T_1/T_2<1.4;$$

wherein $T_1$ represents a temperature at which the binder resin has an apparent viscosity of $10^4$ Pa·S when measured by a flow tester; and $T_2$ represents a temperature at which the resin charge controlling agent has an apparent viscosity of $10^4$ Pa·S when measured by a flow tester.

68. The image forming apparatus of claim 58, wherein the resin charge controlling agent is present in an amount of from 0.1 to 20% by weight based on total weight of the toner.

69. The image forming apparatus of claim 58, wherein the colorant comprises a compound classified in C.I. Pigment Yellow 180.

70. The image forming apparatus of claim 58, wherein the colorant comprises a compound having the following formula (1):

(1)

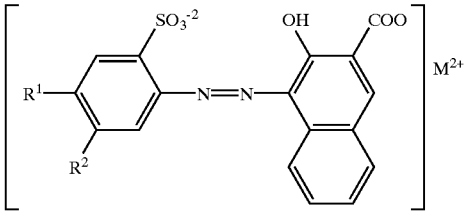

wherein $R^1$ and $R^2$ are each, independently, selected from the group consisting of a hydrogen atom, an alkyl group, a phenyl group and a halogen atom; and M is Ba, Ca, Sr, Mn or Mg.

71. A color image forming apparatus comprising:

an image developer comprising plural developing portions each comprising a different color developer comprising a different color toner and configured to develop electrostatic latent images formed on plural image bearers with the plural different color developers to form a different color toner image on each of the latent image bearers; and a transferer configured to transfer the color toner images onto a receiving material one by one while pressing the receiving material against each of the latent image bearers, wherein each of the different color toners is the toner according to claim 1.

72. The color image forming apparatus of claim 71, wherein the binder resin has an endothermic peak in a temperature range of from 60 to 70° C. when measured by a differential scanning calorimeter.

73. The color image forming apparatus of claim 71, wherein the binder resin has a ratio (Mw/Mn) of from 2 to 10, wherein Mw represents a weight average molecular weight and Mn represents a number average molecular weight.

74. The color image forming apparatus of claim 71, wherein the binder resin has an acid value not greater than 20 KOH mg/g.

75. The color image forming apparatus of claim 71, wherein the binder resin has an apparent viscosity of $10^4$Pa·S when measured by a flow tester at a temperature of from 95 to 120° C.

76. The color image forming apparatus of claim 71, wherein the unit obtained from the monomer having a sulfonate group is present in an amount of from 1 to 30 by weight; the unit obtained from the aromatic monomer having an electron absorption group is present in an amount of from 1 to 80% by weight; and the unit obtained from one member selected from the group consisting of an acrylic ester monomer and a methacrylic ester monomer is present in an amount of from 10 to 80% by weight, based on total weight of the resin charge controlling agent.

77. The color image forming apparatus of claim 71, wherein the aromatic monomer having an electron absorption group is at least one member selected from the group consisting of a phenylmaleimide substituted by at least one member selected from the group consisting of a chlorine atom and a intro group; and a phenylitaconimide substituted by at least one member selected from the group consisting of a chlorine atom and a nitro group.

78. The color image forming apparatus of claim 71, wherein the resin charge controlling agent has an apparent viscosity of $10^4$Pa·S when measured by a flow tester at a temperature of from 85 to 110° C.

79. The color image forming apparatus of claim 71, wherein the resin charge controlling agent has a number average molecular weight of from 1,000 to 10,000.

80. The color image forming apparatus of claim 71, wherein the binder resin and the resin charge controlling agent satisfy the following relationship:

$$0.9<T_1/T_2<1.4;$$

wherein $T_1$ represents a temperature at which the binder resin has an apparent viscosity of $10^4$ Pa·S when measured by a flow tester; and $T_2$ represents a temperature at which the resin charge controlling agent has an apparent viscosity of $10^4$ Pa·S when measured by a flow tester.

81. The color image forming apparatus of claim 71, wherein the resin charge controlling agent is present in an amount of from 0.1 to 20% by weight based on total weight of the toner.

82. The color image forming apparatus of claim 71, wherein the colorant comprises a compound classified in C.I. Pigment Yellow 180.

83. The color image forming apparatus of claim 71, wherein the colorant comprises a compound having the following formula (1):

(1)

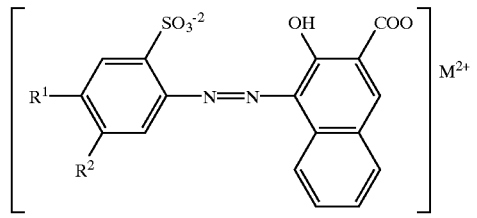

wherein $R^1$ and $R^2$ are each, independently, selected from the group consisting of a hydrogen atom, an alkyl group, a phenyl group and a halogen atom; and M is Ba, Ca, Sr, Mn or Mg.

* * * * *